US012245642B2

(12) United States Patent
Davis et al.

(10) Patent No.: US 12,245,642 B2
(45) Date of Patent: Mar. 11, 2025

(54) APPARATUS, SYSTEM AND METHOD FOR FILLING BAT PIPES

(71) Applicant: Pre-Pack, Inc., Narragansett, RI (US)

(72) Inventors: Austin Davis, Narragansett, RI (US); Jeffrey LeBlanc, East Greenwich, RI (US)

(73) Assignee: Pre-Pack, Inc., Narragansett, RI (US)

( * ) Notice: Subject to any disclaimer, the term of this patent is extended or adjusted under 35 U.S.C. 154(b) by 1019 days.

(21) Appl. No.: 17/142,538

(22) Filed: Jan. 6, 2021

(65) Prior Publication Data

US 2021/0212359 A1 Jul. 15, 2021

Related U.S. Application Data

(60) Provisional application No. 62/960,369, filed on Jan. 13, 2020.

(51) Int. Cl.

| | |
|---|---|
| ***A24F 9/02*** | (2006.01) |
| ***A24F 1/26*** | (2006.01) |
| ***A24F 1/28*** | (2006.01) |
| ***A24F 5/10*** | (2006.01) |
| *A24F 9/16* | (2006.01) |

(52) U.S. Cl.

CPC ..... *A24F 9/02* (2013.01); *A24F 1/26* (2013.01); *A24F 1/28* (2013.01); *A24F 5/10* (2013.01); *A24F 9/16* (2013.01)

(58) Field of Classification Search

CPC ..... A24F 1/26; A24F 1/28; A24F 9/02; A24C 5/02; A24C 5/06; A24C 5/47; A24C 5/474

See application file for complete search history.

(56) References Cited

U.S. PATENT DOCUMENTS

| | | | | |
|---|---|---|---|---|
| 4,827,827 | A * | 5/1989 | Sanfilippo | F42B 33/0292 222/572 |
| 10,604,292 | B1 * | 3/2020 | Dodson | B65B 39/007 |
| D910,201 | S | 2/2021 | Evans et al. | |
| 2018/0134423 | A1 * | 5/2018 | Narvekar | B65B 43/59 |

* cited by examiner

*Primary Examiner* — Philip Y Louie
*Assistant Examiner* — Yana B Krinker
(74) *Attorney, Agent, or Firm* — Hinckley, Allen & Snyder, LLP; David Josephs

(57) ABSTRACT

The present invention provides an apparatus and method for speed filling of a containers, such as bat pipes, that reside in a shipping container. A filling tray includes holes that align with top open ends of the bat pipes. A frame on the filling tray aligns the top open ends of the bat pipes. Smokable plant matter is spread onto the top surface of the filling tray to introduce the smokable plant matter into the holes of the filling tray and further into the top open ends of the bat pipes. A press plate, with a matrix of corresponding pegs, is urged downwardly to compress smokable plant matter into the top open ends of each of the bat pipes. After being filling with smokable plant matter, the top open ends of the bat pies are sealed with caps.

16 Claims, 32 Drawing Sheets

APPARATUS, SYSTEM AND METHOD FOR FILLING BAT PIPES

CROSS REFERENCE TO RELATED APPLICATIONS

This application is related to, and claims benefit from, U.S. Provisional Application No. 62/960,369, filed on Jan. 13, 2020, entitled "APPARATUS, SYSTEM AND METHOD FOR FILLING BAT PIPES," incorporated by reference in its entirety, herein.

BACKGROUND OF THE INVENTION

The present invention generally relates to the manufacture of smoking products, and more particularly, to apparatus, systems and methods for efficiently filling smoking devices with ground plant matter. In particular, the present invention relates to an apparatus, system and method for filling a smoking device, such as a bat pipe, for storage of the smokable plant matter therein and for later smoking the smokable plant matter using the same device. Such devices, including bat pipes, are very well known for such storage and smoking of smokable planet matter. The present invention is applicable to all industries that utilize herbal material, including but not limited to tobacco, spices and ground smokable plant matter.

Many of the chemical compounds synthesized by plants have been found to have favorable, enjoyable, or beneficial effects when consumed by humans. These effects can be either short-term or long-term, and they may impact a human's health, mental state, and/or other attributes. As a result, humans have taken to the consumption of plant-synthesized chemical compounds (also known as "phytochemicals") for both medicinal and recreational purposes.

As a means for consuming phytochemicals, humans have adopted the practice of smoking, where plant matter containing phytochemicals, such as tobacco or *Cannabis*, is burned to produce inhalable smoke. Humans have created several devices to facilitate smoking, such as pipes or hookahs, but many prefer the convenience of carrying the smokable plant matter in the same device as the pipe used for smoking the plant matter. Bat pipes are a well-known type of such device. This also facilitates the sale of the plant matter in a convenient and ready-to-use form where the smokable plant matter is pre-filled and the package can be clearly marked for ease of sale and purchase by the consumer with clarity of the contents filled therein. Thus, the smokable plant matter can be carried and transported by the user and then later smoked when desired.

In general, it is well known in the art to provide a smoking device 10, such as bat type pipe device, as can be seen in FIGS. 1A-1C. As in FIG. 1A, such a bat pipe device 10 typically includes a preferably glass cylindrical body 12 with a smokable plant storage chamber 14 and a smoke chamber 16 with a small passage 18 fluidly connecting the two chambers 14, 16 together. The smoke chamber 16 includes an intake hole 20 by which the user draws the smoke. FIG. 1B shows a fillable storage chamber 14, which also acts as a bowl for holding smokable plant matter 22 during combustion and smoking, has an open end 24. A cap 26 is provided to close the plant storage chamber 14 after it is filled with smokable plant material 22 to retain the smokable plant matter 22 during shipping and storage. The cap 26 is typically made of plastic but could be made of any other material that is appropriate for the material of the bat pipe 10 and smokable plant matter 22 contained therein.

FIG. 1C shows the filled and sealed bat pipe 10 with smokable plant matter 22 secured therein.

As shown in FIGS. 1A-C, bat pipes 10 are typically filled by a manual filling process whereby the smokable plant matter 22, which is typically ground first, is loaded into the plant storage chamber 14 when the bat pipe 10 is in a vertical position with the open end 24 of the plant storage chamber 14 facing upwards. Thus, gravity assists in the loading process to maintain the smokable plant matter 22 in place in the plant storage chamber 14 until the cap 26 is secured.

The user, with their fingers or with the assistance of a scoop or other device, manually fill the plant storage chamber 14 to a desire level and compactness. After filling to the desired amount, the plant storage chamber 14 is sealed with a cap 26. As a result, the smokable plant matter 22 is contained and stored within the bat pipe 10, which facilitates shipping, storage and transit by the user. However, as can be understood, filling multiple containers is labor intensive, time consuming and expensive, which results in inconsistent quantities filled in containers, inconsistent compaction levels, wasted product and containers from excessive handling.

As is also well-known, when the user desires to smoke the smokable plant matter 22, the cap 26 is removed and the smokable plant matter 22 is exposed and then combusted using a flame while air is drawn through the intake hole 20 on the opposing side. Use and operation of such a bat pipe 10 is very well known in the art and need not be discussed in further detail herein.

While this filling process is suitable on a small scale or for individual use, it is not suitable for large scale production and filling of such devices. Moreover, manual filling of bat pipes 10 and similar containers can yield inconsistent filling resulting in varying product with the same batch or run of filled smoking devices. Also, as pre-filled containers and pipe devices become more popular with a demand for known and consistent commoditized smokable products and precise dosing, it has become important that the filling of such devices be as fast as possible, be carried out at the same time for large scale mass production and that the resultant filled products be as consistent with each other as possible for quality product delivery to the consumer.

Therefore, there is a need for an apparatus, system and method for filling bat pipes and other smokable plant matter storage and smoking devices that address the foregoing concerns.

SUMMARY OF THE INVENTION

The apparatus, system and method of the present invention is configured for speed filling of a containers for smokable plant matter that reside in a shipping container or packing box loaded with empty containers (bat pipes or the like). The present invention includes a filling (loading) tray that includes of a matrix or array of holes that aligns concentrically/co-axially with the top open ends of the smoking device, namely, the plant storage chambers of the smoking device, such as a bat pipe. Further, the underside of the filling tray has an integrated frame detail that downwardly depends from the bottom surface of the filling tray. The frame includes alignment walls, surfaces, tapered inner edges and/or a patterned perimeter shape that sequences the containers and locates the filling tray over the top open ends of the bat pipes such that the holes of the filling tray matrix and container openings of the bat pipes are aligned. The filling tray may also be configured so that that it snaps with a secure fit on to the array of containers in the shipping packing box. In sum, the filling tray not only aligns the holes of the filling tray with the top open ends of storage chambers of the bat pipes but assists in aligning the bat pipes themselves within the packing box.

Once the filling tray with holes is secured in place to the containers, the smokable plant matter is loaded on to the top working surface of the filling tray and then spread about, preferably with the assistance of a spreading tool, to introduce the smokable plant matter into the holes of the filling tray and further downwardly into the plant storage chambers of each of the containers, namely the bat pipe devices. Gravity further assists with the downward travel of the smokable plant matter into the plant storage chamber of each container. A pre-measured amount of smokable plant matter can be used for a corresponding number of containers to be filled to further speed up the filling process in that the user would understand that all of the pre-measured smokable plant matter will need to be delivered through the holes of the filling tray and downwardly into the containers. For example, enough smokable plant matter can be provided onto the filling tray to provide, 0.25 g to 0.35 gram of smokable plant matter, for example, for each container. Of course, other sizes and amounts may be used depending on the size of the bat pipe device and its plant storage chamber and the desired size of the prefilled amount of smokable plant matter.

Once the containers are filled, a press plate, which has a matrix of pegs or posts that align and interface with the holes in the filling tray and container openings of the bat pipes, is inserted into and mated with the filling tray. The press plate is orientated with the filling tray and downward pressure is then applied which causes the pegs to pass through the holes in the filling tray and penetrate the openings in the containers to, thereby, compress and pack the smokable plant matter in each of the containers. The press plate also pushes the smokable plant matter in each container down enough so that a seal cap, discussed below, can be secured to the top portion of the container with no smokable plant matter between the cap and the (glass) container itself. Thus, if smokable plant matter can be cleared from the seal region of the cap to the container, a better and more reliable cap seal will result.

The mated filling tray and press plate are removed and any excess smokable plant matter is poured out revealing the packed and pre-compressed containers with smokable plant matter in each respective container. Caps are then secured and sealed to the top open ends of the filled containers. Thus, the containers can be filled and then capped off all without removing the containers from the shipping packaging. The resultant filled and capped containers can then be shipped to a seller of the pre-filled containers, such as a dispensary, at retail.

Therefore, the object of the present invention is to provide an apparatus, system and method that can fill multiple containers of smokable plant matter quickly at the same time. There is a further object of the present invention to provide such an apparatus, system and method that reduces costs by materially reducing time and labor. There is yet another object of the invention to consistently fill each container with the same amount of material and to materially reduce waste. Moreover, there is an object of the present invention to streamline the preparation of the containers and filling process. For example, there is an object of the present invention to obviate the need to remove the containers to be filled from their bulk shipping package thereby substantially reducing handling, labor, costs, waste and breakage of the containers. There is a further object of the present invention to eliminate the need to pre-measure quantities of material to be filled into containers, which saves time and labor during the filling process. There is yet a further object of the present invention to compress or pack the smokable plant matter in the container to eliminate mounding and spillage of smokable plant matter.

BRIEF DESCRIPTION OF THE DRAWING FIGURES

The novel features that are characteristic of the present disclosure are set forth in the appended claims. However, the disclosure's preferred embodiments, together with further objects and attendant advantages, will be best understood by reference to the following detailed description taken in connection with the accompanying drawings in which:

DESCRIPTION OF THE INVENTION

Figure 2:
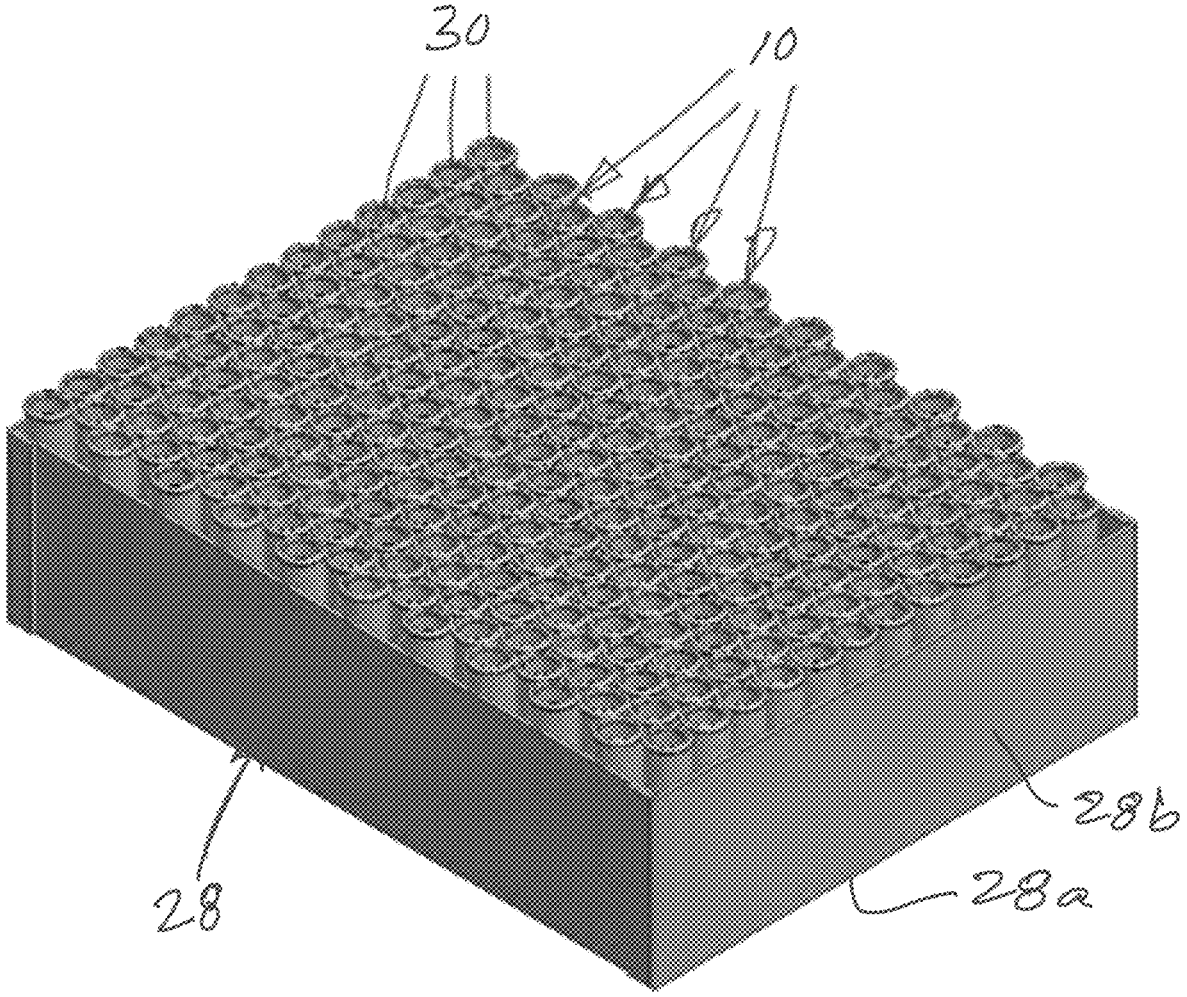
FIG. 2 shows an array of glass bat pipes located in a shipping container of packing box.

The apparatus, system and method of the present invention is configured for speed filling of a containers, such as bat pipes 10, that reside in a packing box 28 loaded with such empty containers 10 (bat pipes or the like). The packing box 28 preferably includes a bottom surface 28*a* and side walls 28*b*. For example, FIG. 2 shows such a packing box 28 where an array of 250 empty bat pipes is provided with top open ends 30 exposed in preparation for filling. It should be noted that an array of 250 bat pipes 10 is one example array of containers that can be stored in a packing box 28 for filling by the present invention. Different sizes and different configurations of containers 10 may be employed depending on the application and needs at hand. Also, for ease of explanation and illustration, the containers 10 are described hereinbelow as bat pipes 10 but it should be understood that any type of container or smoking device 10 may be filling using the apparatus, system and method of the present invention.

It should also be noted that the packing box 28 may be made of any material but corrugated paper, for example, is preferred. But other materials may be used for the packing box 28. A lid or cover (not shown) of the same or different material may also be used for protection of the bat pipes 10 residing therein.

Turning now to FIGS. 3-7, the present invention includes a filling (loading) tray 32 that includes of a matrix of holes that aligns concentrically with the top open ends of the bat pipes 10, namely plant storage chambers 14 of the bat pipes 10.

Figure 3:
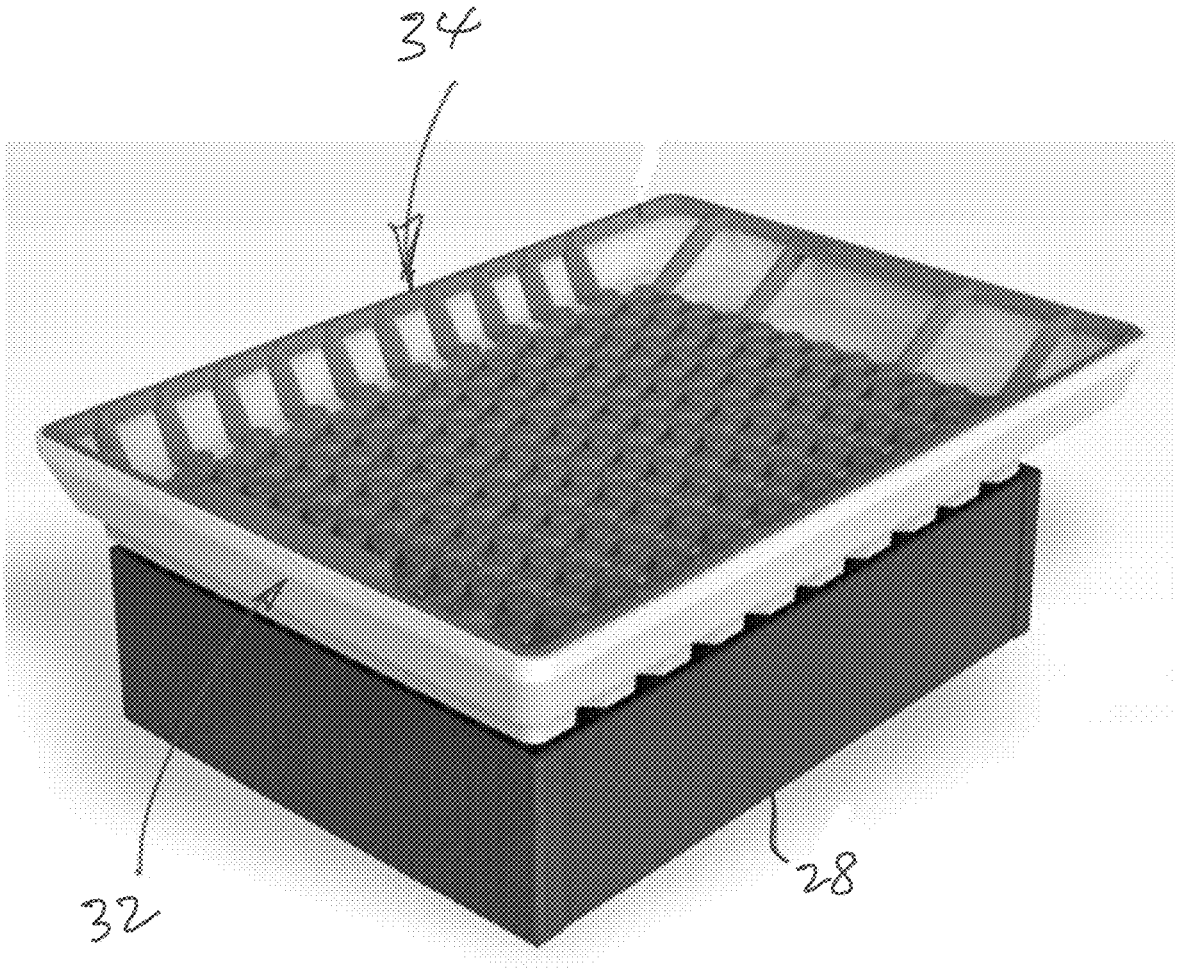
FIG. 3 shows a front perspective view of an assembled configuration of the apparatus of the invention with filling tray and press plate residing on top of an array or matrix of bat pipes.
Figure 4:
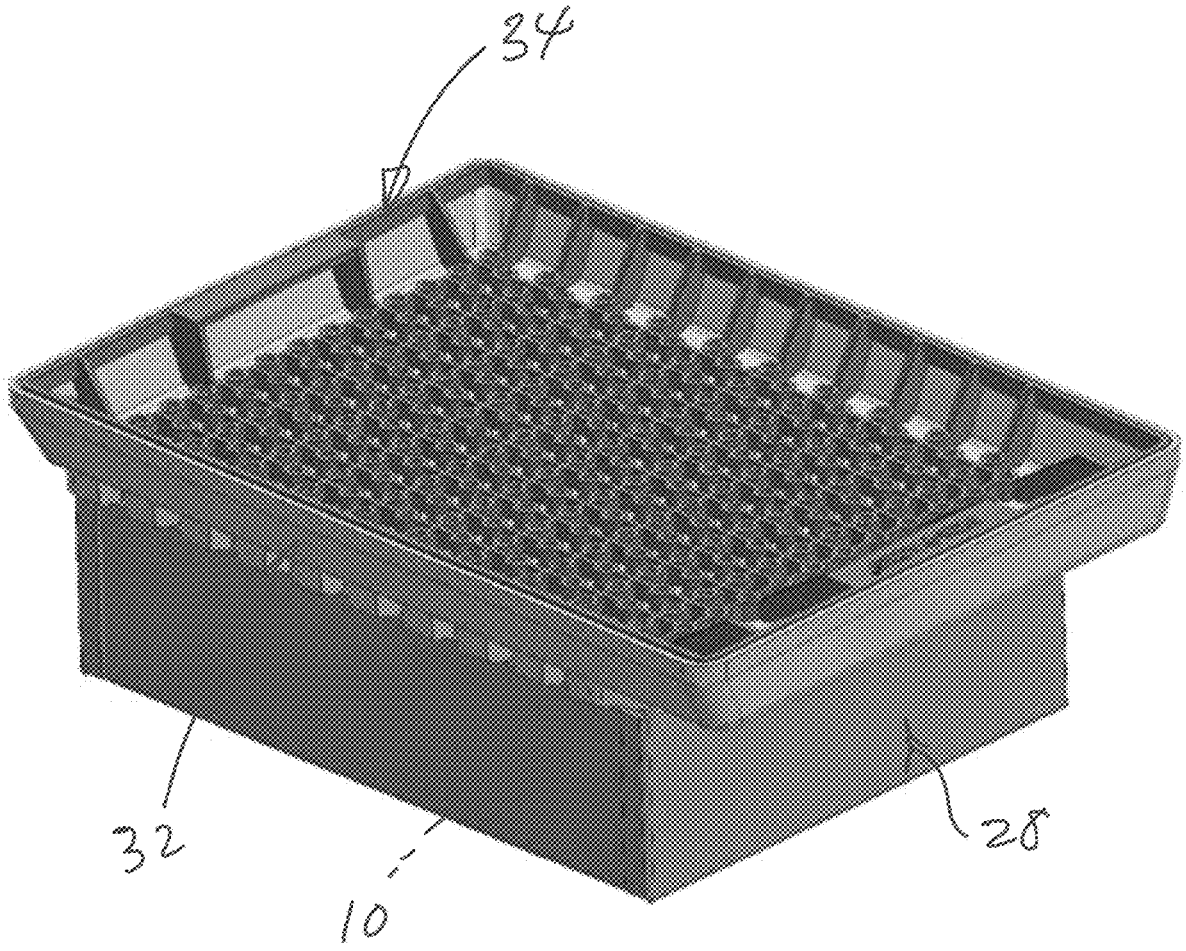
FIG. 4 shows an alternative perspective view of an assembled configuration of the apparatus of the invention with filling tray and press plate residing on top of an array or matrix of bat pipes.
Figure 5:
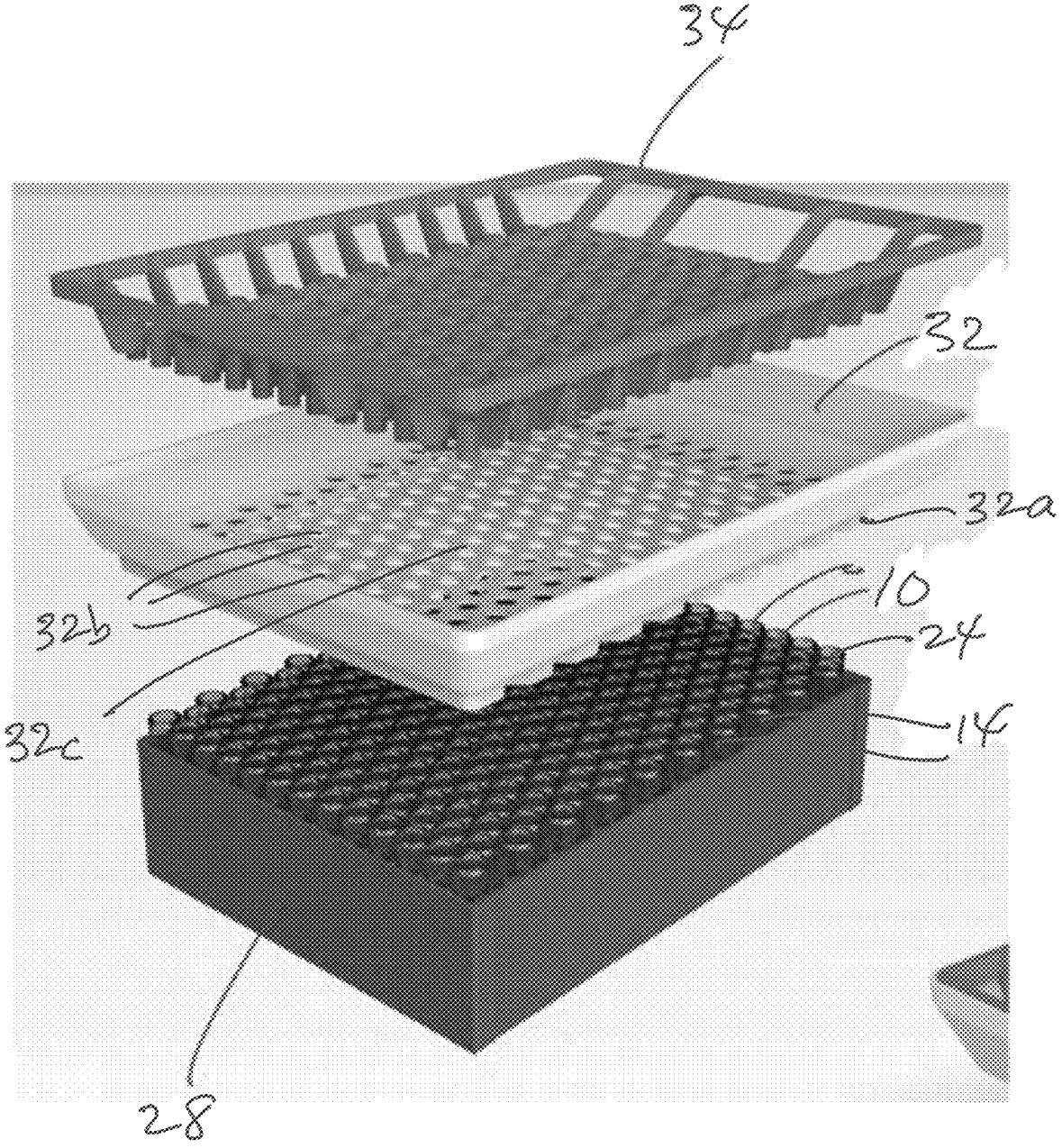
FIG. 5 shows a front exploded perspective view of an assembled configuration of the apparatus of the invention with filling tray and press plate residing on top of an array or matrix of bat pipes.
Figure 6:
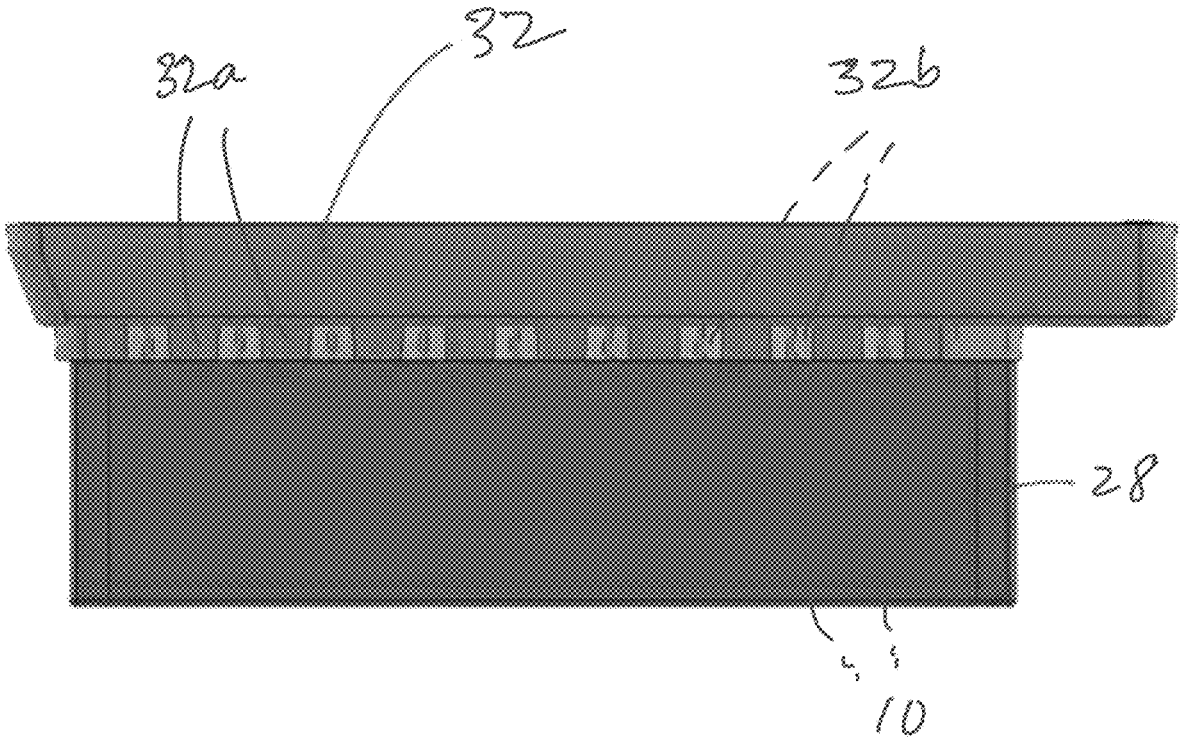
FIG. 6 shows a side elevational view of the assembled configuration of the apparatus of the invention with filling tray and press plate residing on top of an array or matrix of bat pipes.
Figure 7:
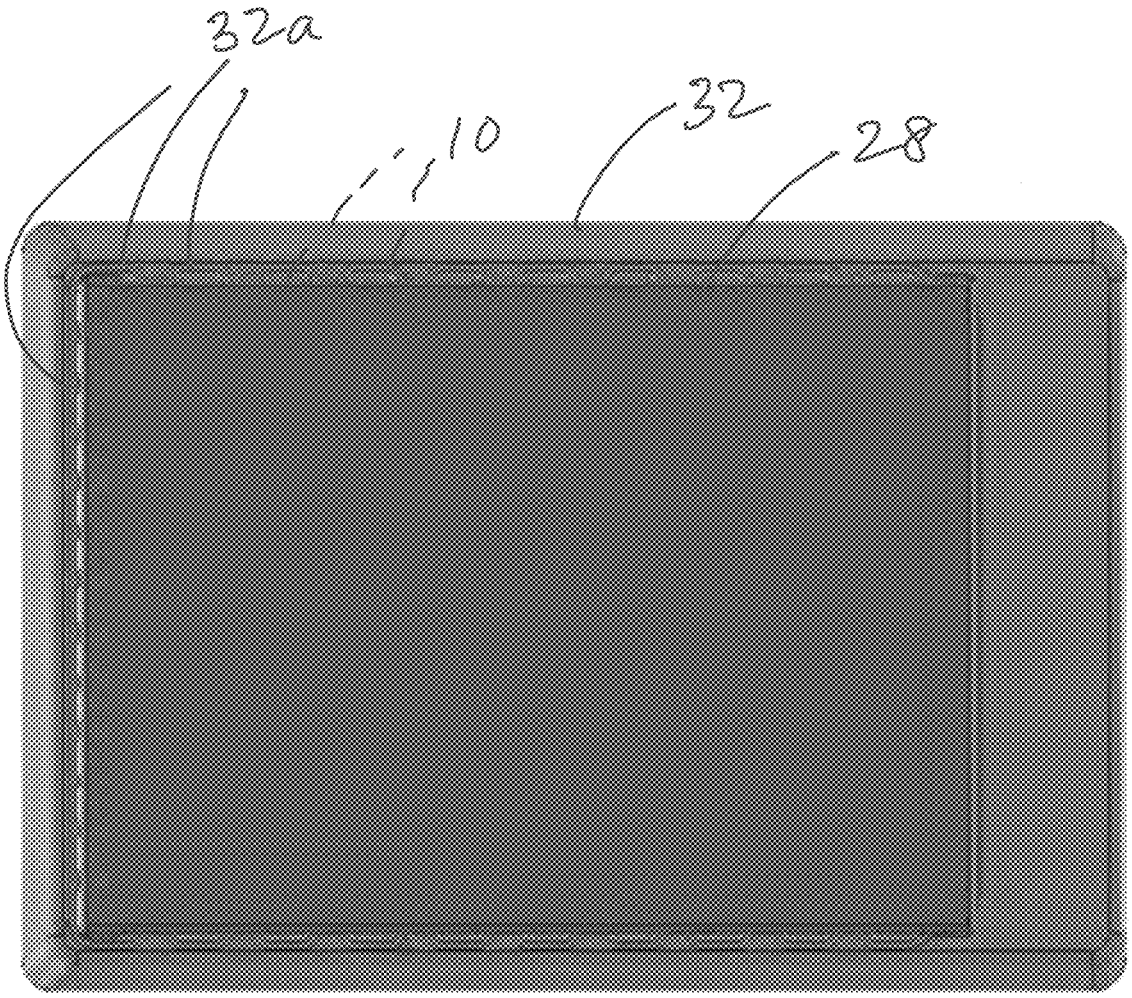
FIG. 7 is a bottom view of the assembled configuration of the apparatus of the invention with filling tray and press plate residing on top of an array or matrix of bat pipes.

FIG. 3 shows a front perspective view of an assembled configuration of the apparatus of the invention with filling tray 32 and press plate 34 residing on top of an array or matrix of bat pipes. The filling tray 32, press plate 34 and packing box 28 of bat pipes 10 are, essentially, vertically stackable and alignable, as will be described in detail below. Moreover, the press plate 34 nests into the filling tray 32, which sits on top of the bat pipes 10 residing in the packing box 28. FIG. 4 shows a rear perspective view of this assembled configuration of the filling tray 32 and press plate 34 on top of an array or matrix of bat pipes 10. FIG. 5 shows this nested arrangement in an exploded view for further illustration. Still further, FIG. 6 shows a side elevational view of the assembled configuration of the filling tray 32 and press plate 34 nested on top of the array of bat pipes 10 while they reside in the packing box 28. Further, FIG. 7 shows a bottom view of the assembled configuration of the apparatus of the invention where it can be seen that the filling tray 32 resides over the packing box 28. The press plate 34 and bat pipes 10 not being directly visible in the view of FIG. 7 but some of the bat pipes shown in shadow for illustration purposes.

Further, the underside of the filling tray 32 has an integrated frame detail 32*a* with alignment walls, surfaces, tapered inner edges and a patterned perimeter shape that sequences the bat pipes 10 and locates the filling tray 32 such that the holes 32*b* of the filling matrix and top openings 24 of bat pipes 10 are aligned.

In general, as in FIGS. 3-7, once the filling tray 32 with holes 32*b* therethrough is secured in place over the bat pipes 10 in the packing box 28, the smokable plant matter 22 is loaded on to the top working surface 32*c* of the filling tray 32 and then spread about, preferably with the assistance of a spreading tool 36, to introduce the smokable plant matter 22 into the holes 32*b* of the filling tray 32 and further into the plant storage chambers 14 of each of the bat pipes 10. A pre-measured amount of smokable plant matter 22 can be used for a corresponding number of bat pipes 10 to be filled to further speed up the filling process in that the user would understand that all of the pre-measured smokable plant matter 22 will need to be delivered through the holes 32*b* of the filling tray 32 and into the respective storage chambers 24 of bat pipes 10.

Figure 8:
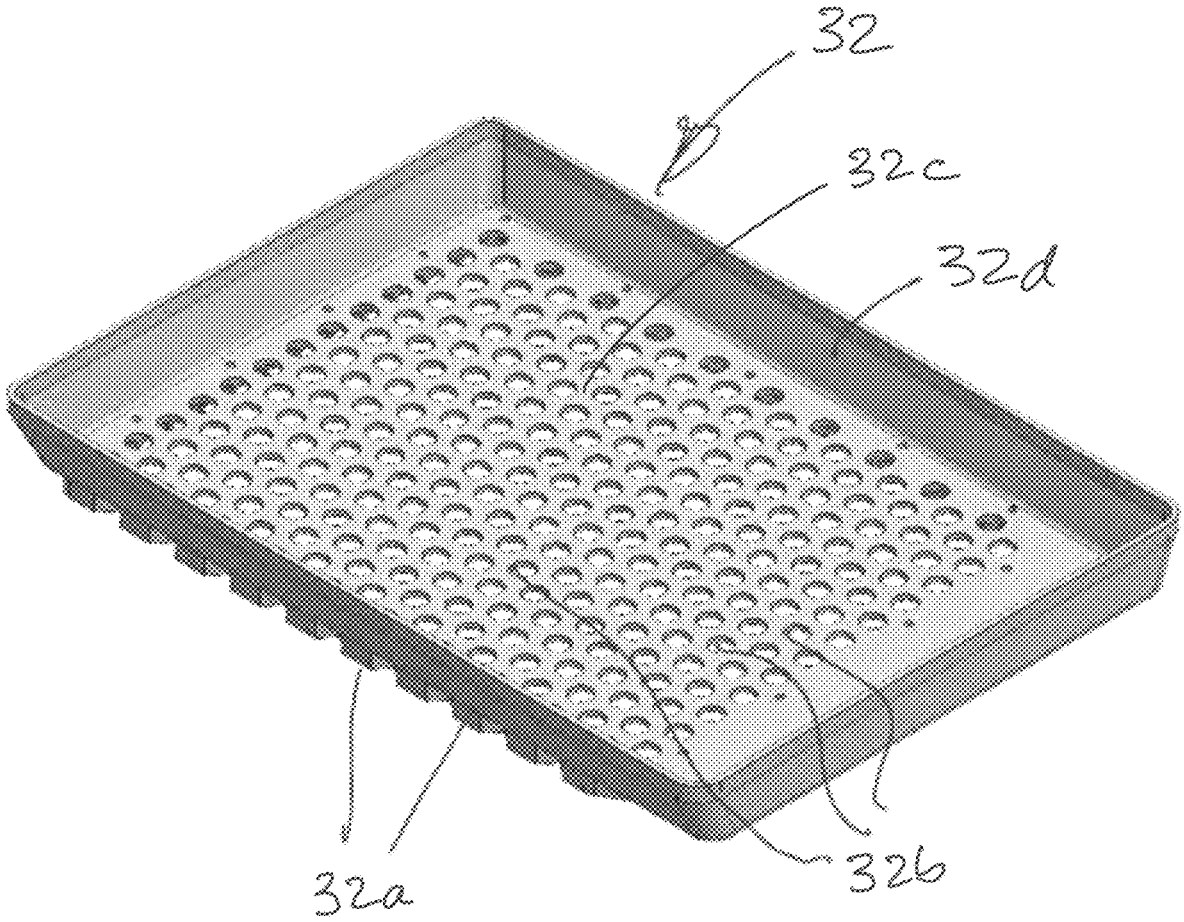
FIG. 8 shows a front perspective view of the filling tray in accordance with the present invention.
Figure 9:
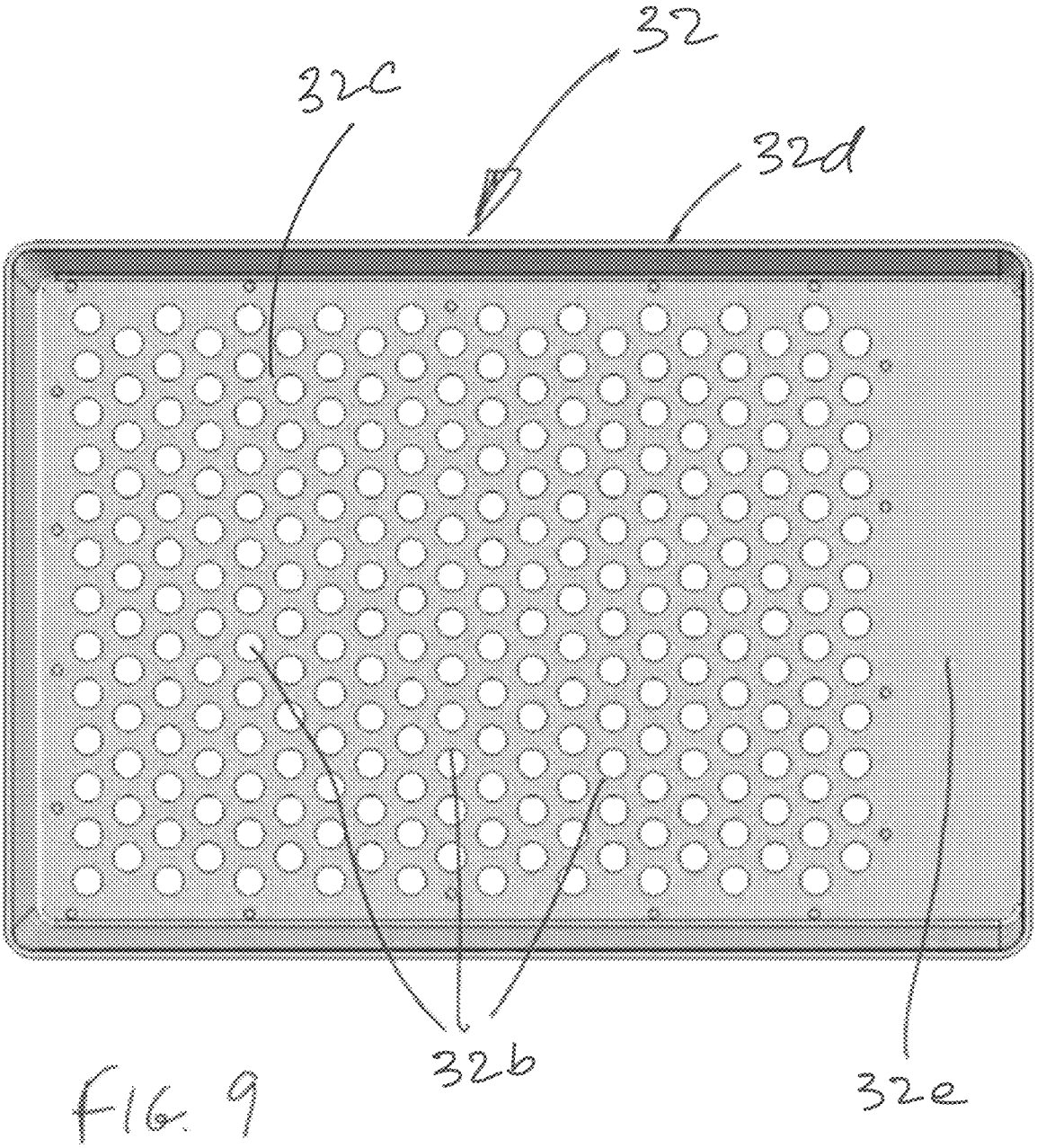
FIG. 9 shows a top view of the filling tray in accordance with the present invention.
Figure 10:
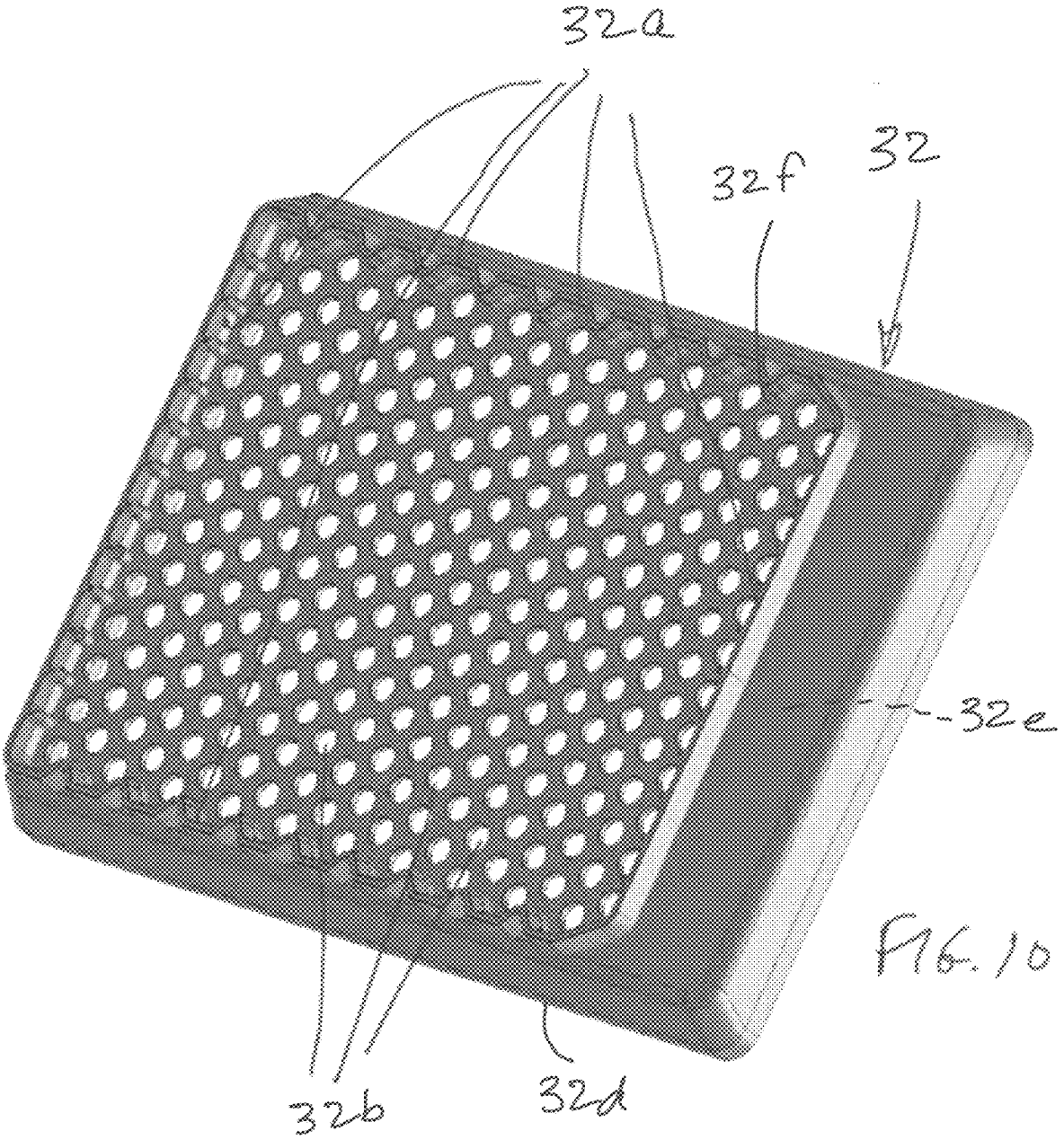
FIG. 10 shows a bottom perspective view of the filling tray in accordance with the present invention.

FIGS. 8-10 show details of the filling tray 32 that preferably has holes 32*b* that are preferably of the same layout, arrangement and number of top open ends 24 of the array of bat pipes 10 in FIG. 2. As in FIG. 8, the filling tray 32 has upstanding side walls 32*d* from its top surface 32*c*, which are provided to contain the smokable plant matter 22 during the spreading and filling process, as will be described below. Various alignment structures 32*a*, in the form of a frame including walls, and other shapes, to assist in aligning the filling tray over the tops of the glass bat pipes 10 so the holes of the filling tray 32 are aligned with the top open ends 24 of the bat pipes 10. FIGS. 8 and 9 show a working area 32*e* on the top surface 32*c* of the filling tray 32, which is to the right of the array of holes 32*b* in the filling tray 32, where excess smokable plant matter 22 can be pushed or spread out of the way during the filling process, as will be described below.

The filling tray 32 is preferably molded plastic but could be made of any other material, such as metal. All of the structures of the filling tray 32 are preferably unitarily formed but also may be separately formed and then attached together.

Figure 16:
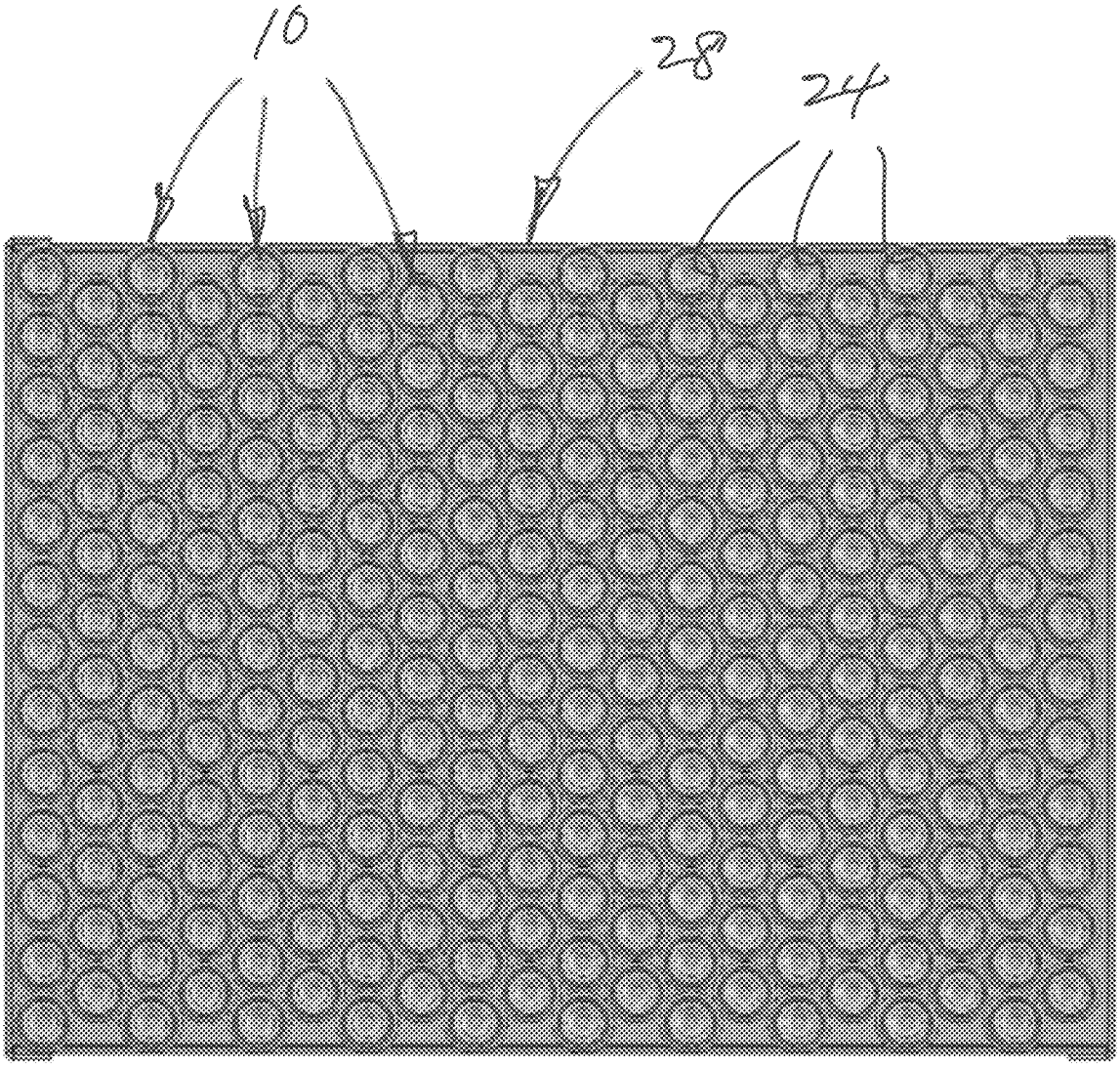
FIG. 16 shows a top view of the array of glass bat pipes located in the packing box.

FIG. 10 further shows a bottom perspective view of the filling tray 32 and the bat pipe alignment structures 32*a* thereon, which are preferably in the form of alignment walls and generally referred to as an alignment frame 32*a*. As can be seen the alignment frame 32*a* defines a border that surrounds the tops of the bat pipes 10. On two opposing sides where the bat pipes 10 are aligned, such as on the left and right portions of the alignment frame 32*a* of FIG. 10, the alignment frame 32*a* is substantially straight. On the upper and lower portions of the alignment frame 32*a*, the alignment frame 32*a* is substantially meandering to substantially follow the general outer contour of the bat pipes 10 as they lie in the packing box 28. The alignment frame 32*a* can be modified to suit a different arrangement and layout of bat pipes 10 as they reside in the packing box 28. Thus, the configuration of the alignment frame 32*a* on the bottom surface 32*f* of the filling tray 32 can be modified to suit the bat pipes 10 as they lie in the packing box 28. A top view of the bat pipes 10 residing in a packing box 28 can be seen in FIG. 16.

Figure 11:
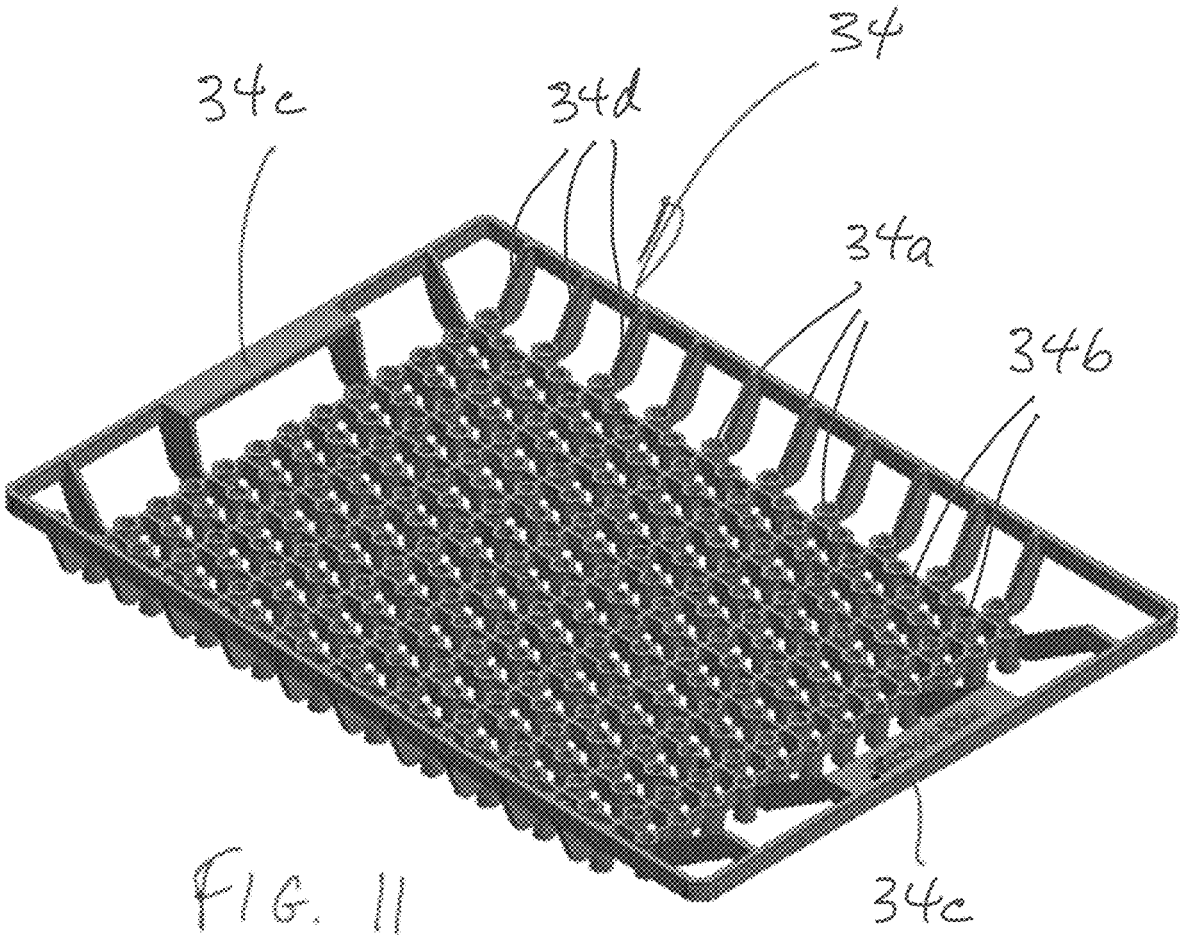
FIG. 11 shows a front perspective view of the press plate in accordance with the present invention.
Figure 12:
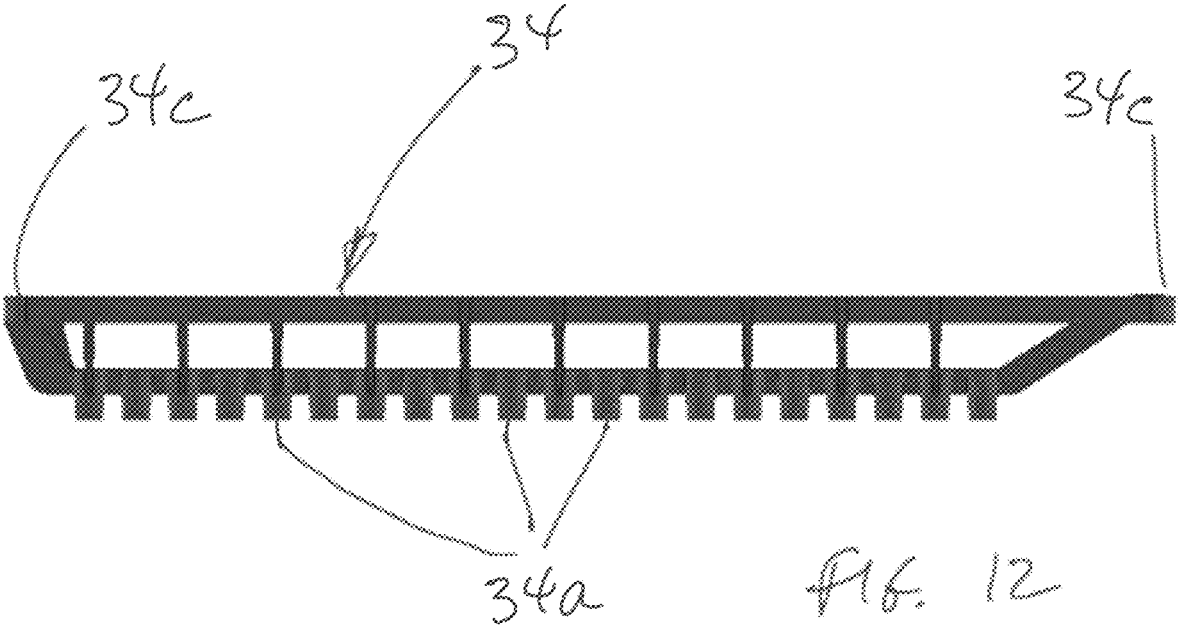
FIG. 12 shows a side elevational view of the press plate in accordance with the present invention.
Figure 13:
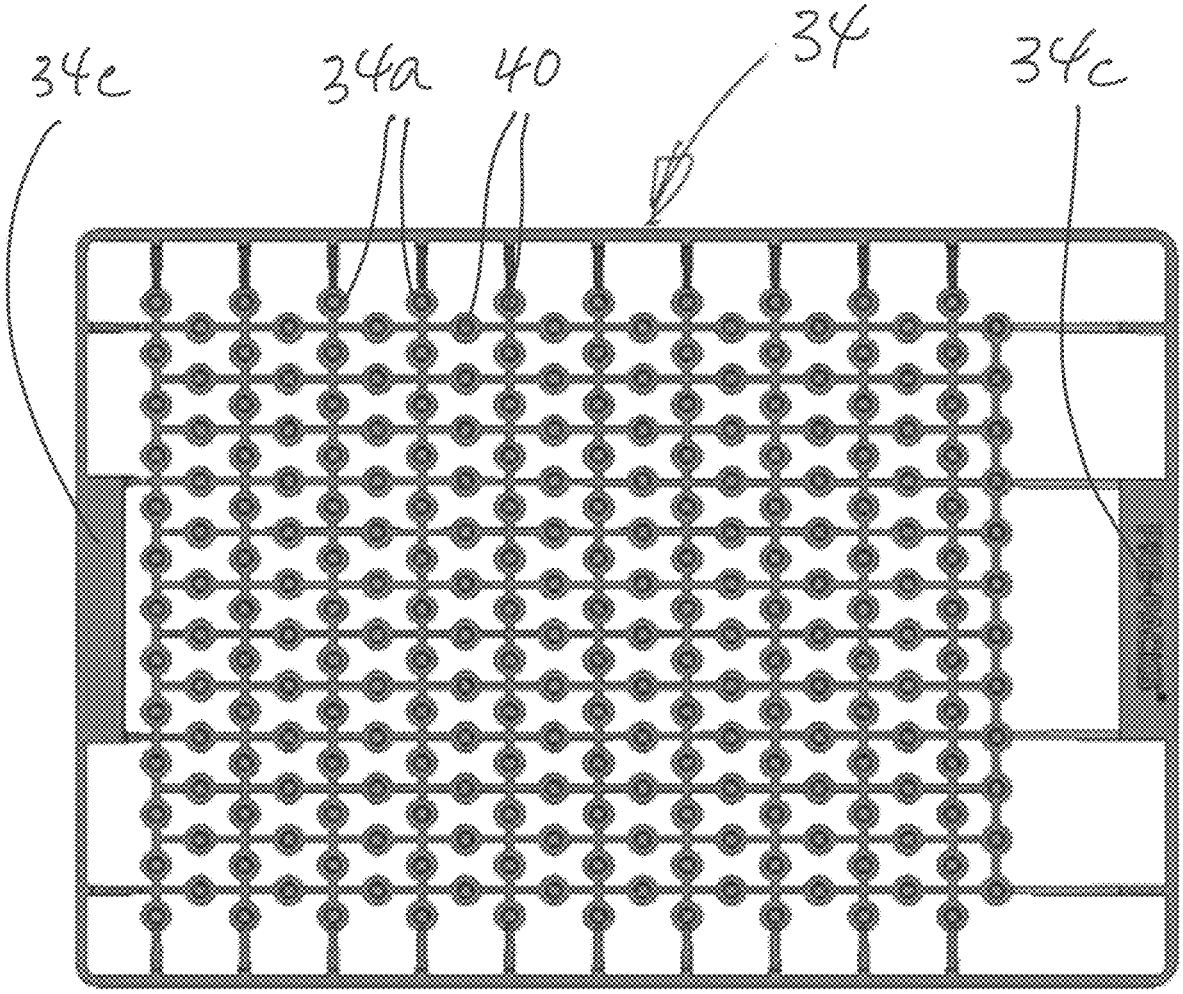
FIG. 13 shows a top view of the press plate in accordance with the present invention.
Figure 14:
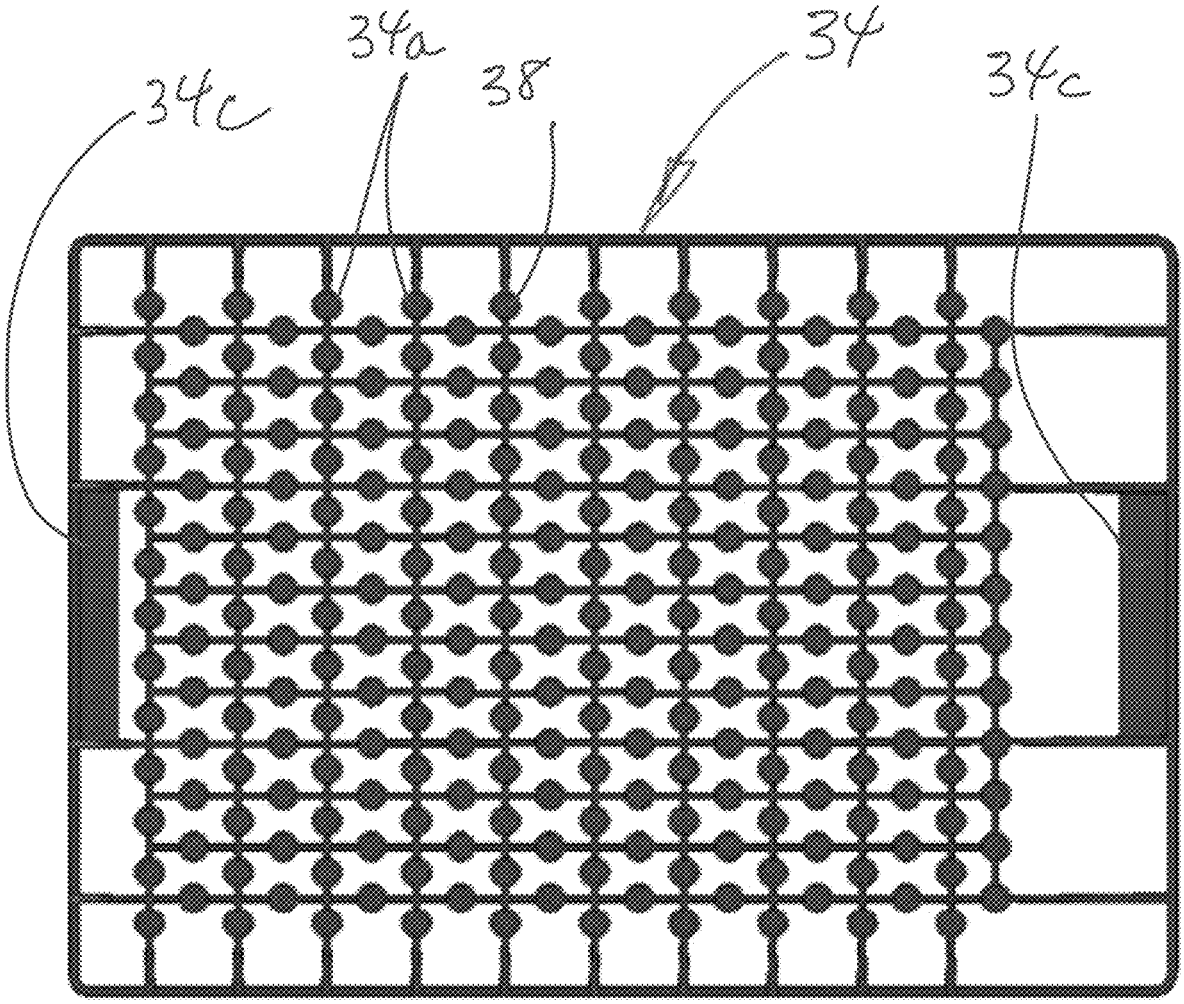
FIG. 14 shows a bottom view of the press plate in accordance with the present invention.

FIGS. 11-14 show details of the press plate 34 in different views. The press plate 34 includes an array of pegs 34*a* interconnected to one another by a number of connection members 34*b* to maintain them in a desired matrix or grid configuration. Preferably two handles 34*c* are connected to the matrix of pegs 34*a* via peripheral connectors 34*d* to facilitate handling and use of the overall press plate 34. The matrix of pegs 34*a* preferably are all aligned vertically and match with the array of holes 32*b* in the filling tray 32. The pegs 34*a* may be cup-like with a solid lower face 38, as see in FIG. 14, to efficiently compress the smokable plant matter, as will be described below. The top portions of the pegs 34, as can be seen in FIGS. 11 and 13, have an open top end 40, for example, to use less material when forming the press plate 34.

Figure 15:
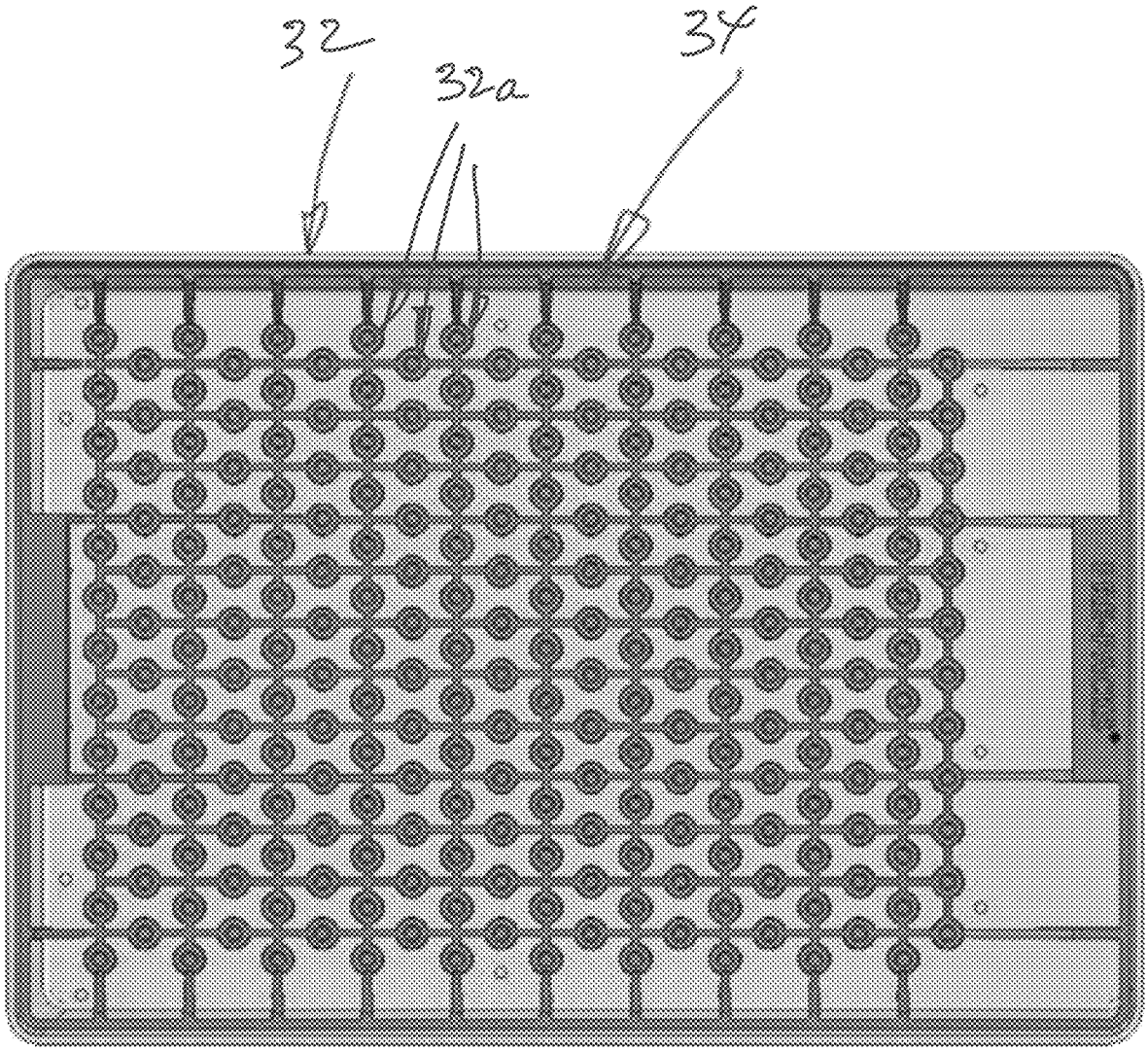
FIG. 15 shows a top view of the press plate nested into the filling tray.

The press plate 34 preferably provides a matrix of pegs 34*a* that matches the entire array of holes 32*b* in the filling tray 32 where a single downward press operation compresses all of the smokable plant matter 22 in all of the bat pipes 10 residing in the packing box 28, a plan view of such full coverage of the press plate 34 over the filling tray 32 can be seen in FIG. 15. Also, the press plate 34 is preferably molded plastic but could be made of any other material, such as metal. All of the structures of the press plate 34 are preferably unitarily formed but also may be separately formed and then attached together.

It is also possible at the press plate 34 has a number of pegs 34*a* that is less than the number of holes 32*b* in the filling tray 32 (not shown). In that alternative embodiment, such a smaller press plate 34 would be used multiple times to compress smokable plant matter 22 into subsets of bat pipes 10 in the packing box 28 through the filling tray 32. In this case the press plate 34 would be smaller but multiple press operations would be required to compress the smokable plant matter 22 into all of the bat pipes 10 in the packing box 28.

Figure 17:
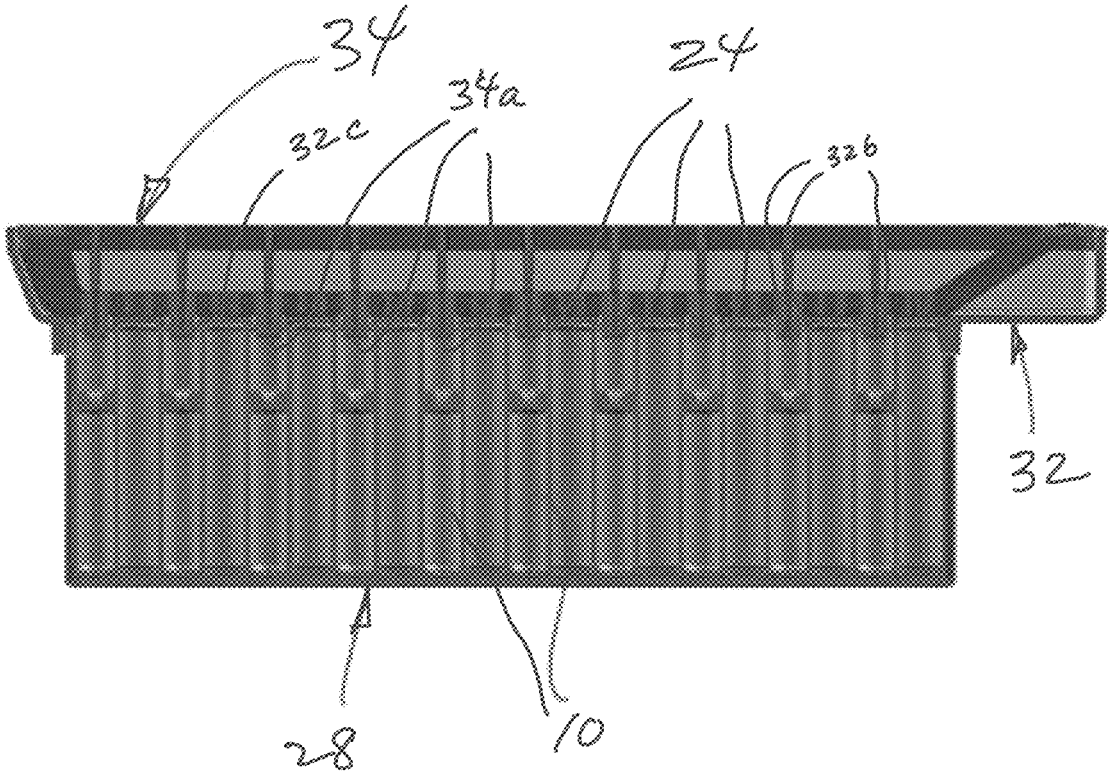
FIG. 17 is a partial cross-sectional view of the filling tray and press plate located on the tops of the array of glass bat pipes.
Figure 18:
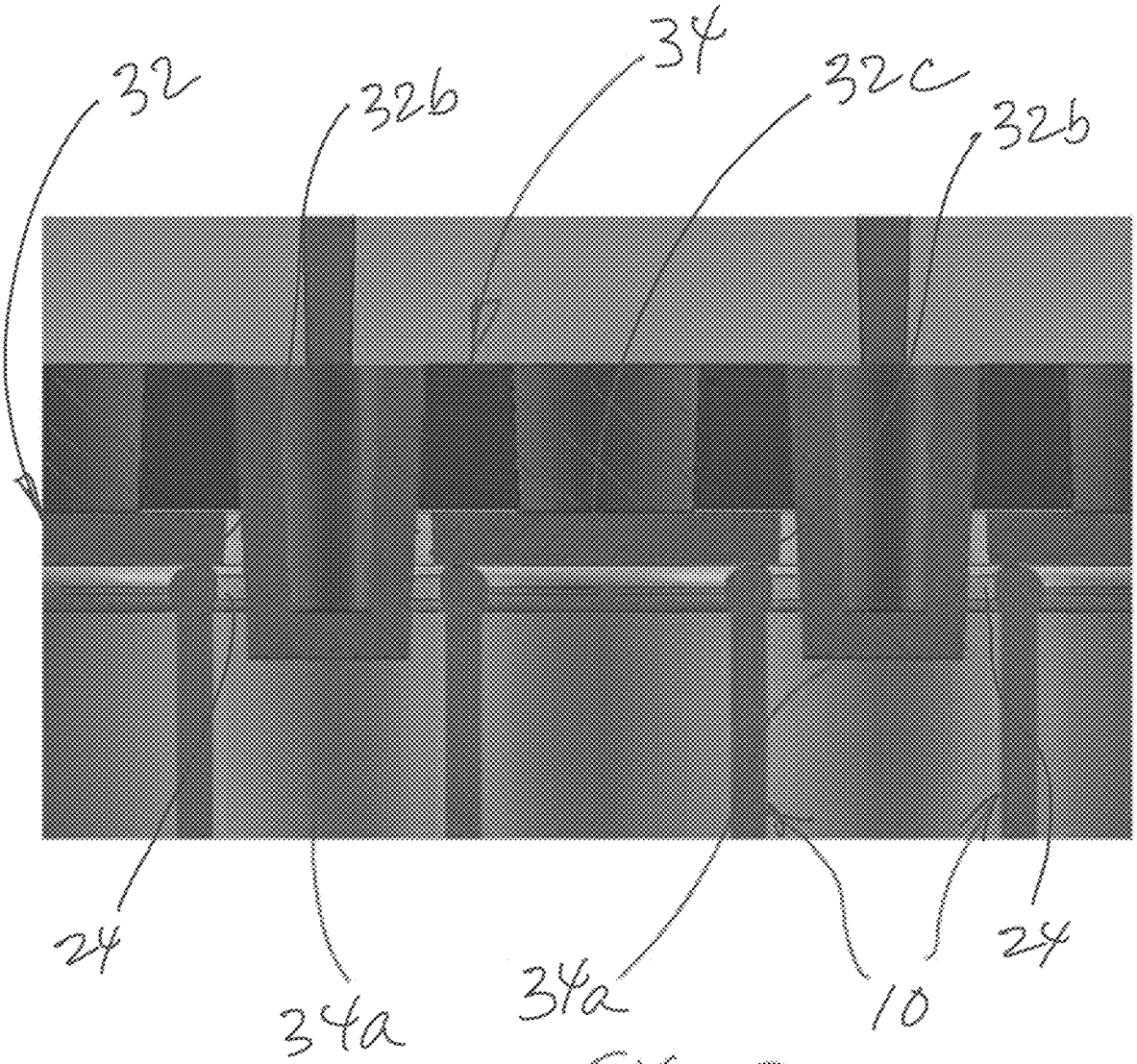
FIG. 18 is a close-up view of FIG. 17.

Further details of the interaction of the press plate 34 into the filling tray 32 and positioning over the array of bat pipes 10 in the packing box 28 is shown in FIGS. 17-20. FIG. 17 shows show a cross-sectional view of the filling tray 32 and press plate 34 located on the tops 24 of the array of glass bat pipes 10 that are residing in the packing box 28. As a result, when the filling tray 32 is secured over the tops of the bat pipes 10, the array of bat pipes 10 are further aligned into a matrix array whereby the top open ends 24 of the bat pipes 10 match the array of holes 32*b* in the filling tray 32. The pegs 34*a* of the press plate 34 further align with the holes 32*b* in the filling tray 32 and the top open ends 24 of the bat pipes 10 that provide access to the storage chambers 14 for smokable plant matter 22. FIG. 18 shows a close-up view to further illustrate how the array of pegs 32*a* extend through the holes 32*b* in the filling tray 32 to, in turn, extend, respectively, into the open top ends 24 of the glass bat pipes 10.

Figure 19:
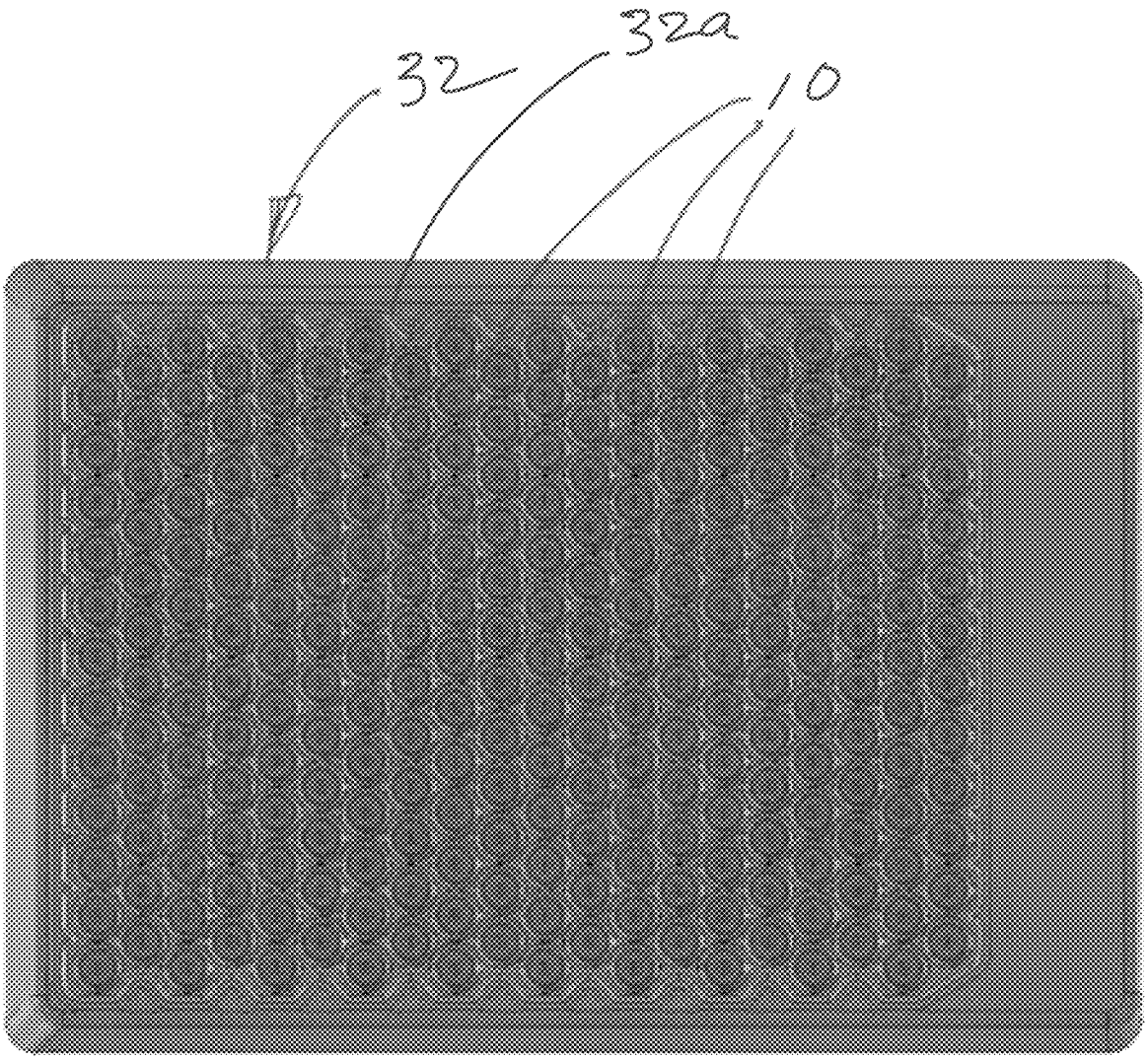
FIG. 19 is a bottom view of the filling tray secured to the tops of the glass bat pipes with the packing box not shown for illustration purposes only.
Figure 20:
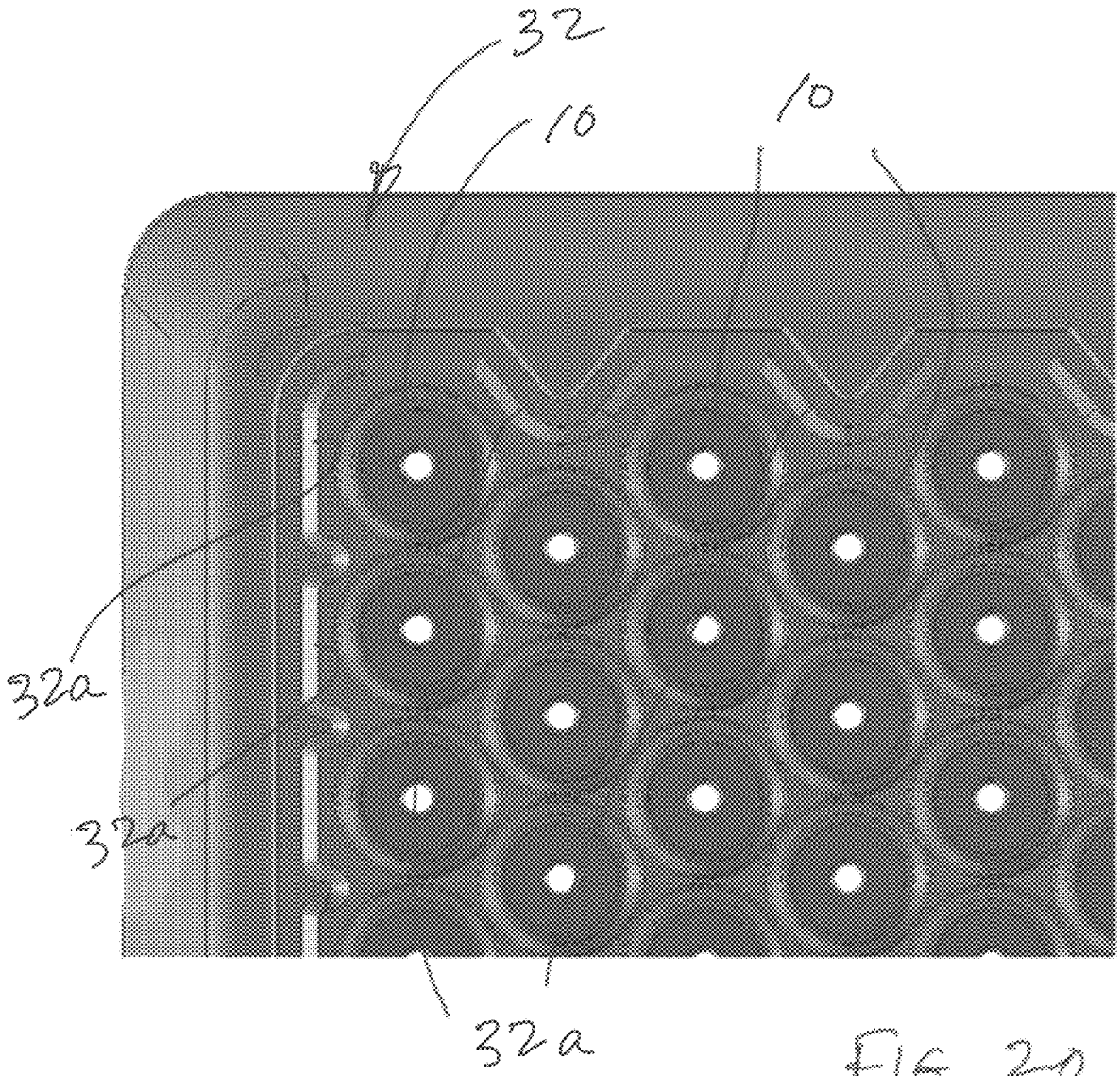
FIG. 20 is a close-up view of FIG. 19.

FIGS. 19 and 20 show a bottom view of the filling tray 32 secured to the top open ends 24 of the glass bat pipes 10. FIG. 19 shows an entire bottom view while FIG. 20 shows a close-up view. The arrangement of the alignment frame 32*a* with downwardly depending wall structures, as described above, helps align the bat pipes 10 into an organized matrix array to facilitate the matching and alignment of their top open ends 24 with the holes 32*b* of the filling tray 32 in preparation for filling of smokable plant matter 22 into the top storage chambers 14 of the bat pipes 10 and then aligned pressing of the pegs 34*a* of the press plate 34 into the top open ends 24 of the bat pipes 10 for compression of the smokable plant matter 22 prior to capping.

Turning now to FIGS. 21-30, the method of the present invention and the use the device and system of the present invention is shown in detail.

Figure 21:
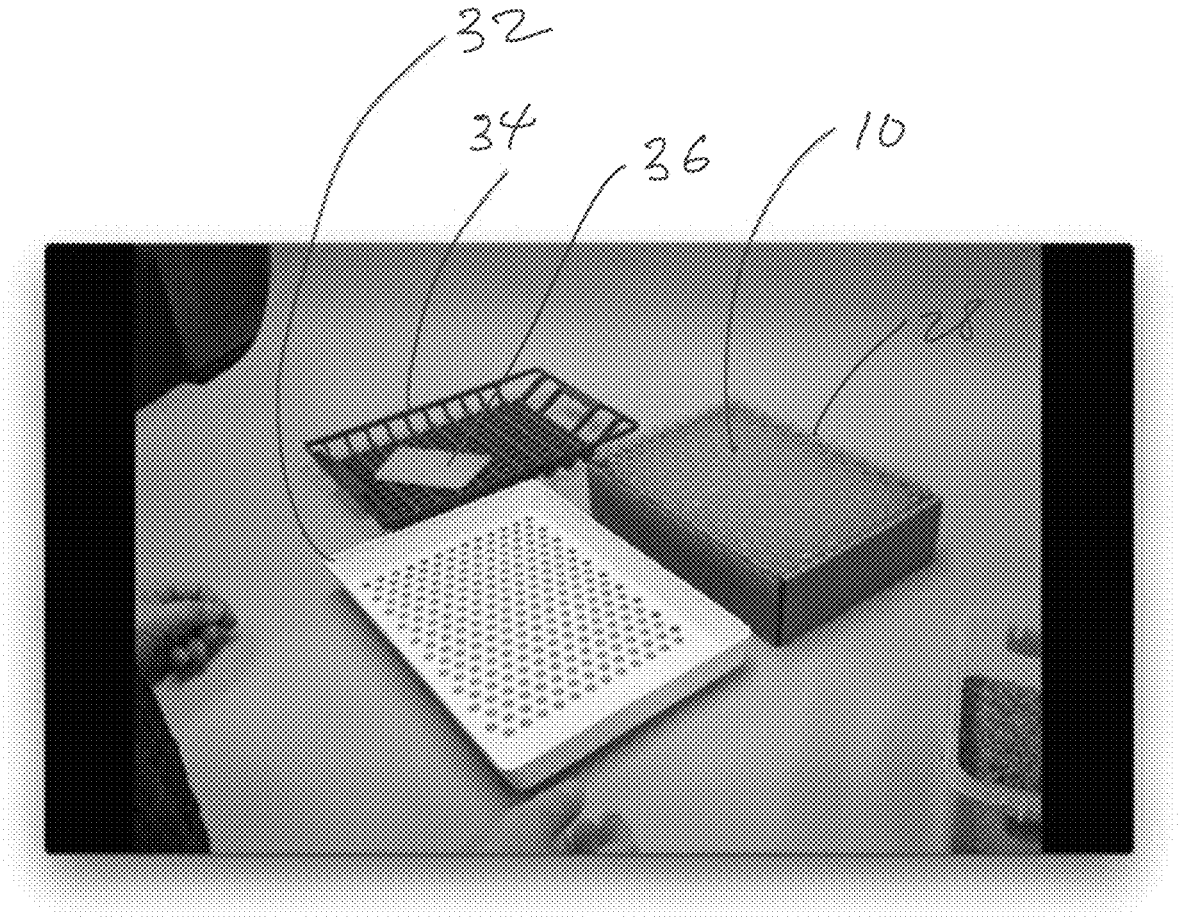
FIG. 21 shows the packing box with bat pipes therein, filling tray, press plate and spreading tool ready for use in accordance with the method of the present invention.

Turning first to FIG. 21, a packing box of empty bat pipes are provided with the top open ends thereof with storage chambers/bowls thereof being exposed. The filling tray and press plate and spreading tool 36 sitting thereon are shown in preparation for use. The spreading tool 36 may be made of any material but is preferably made of plastic.

Figure 22:
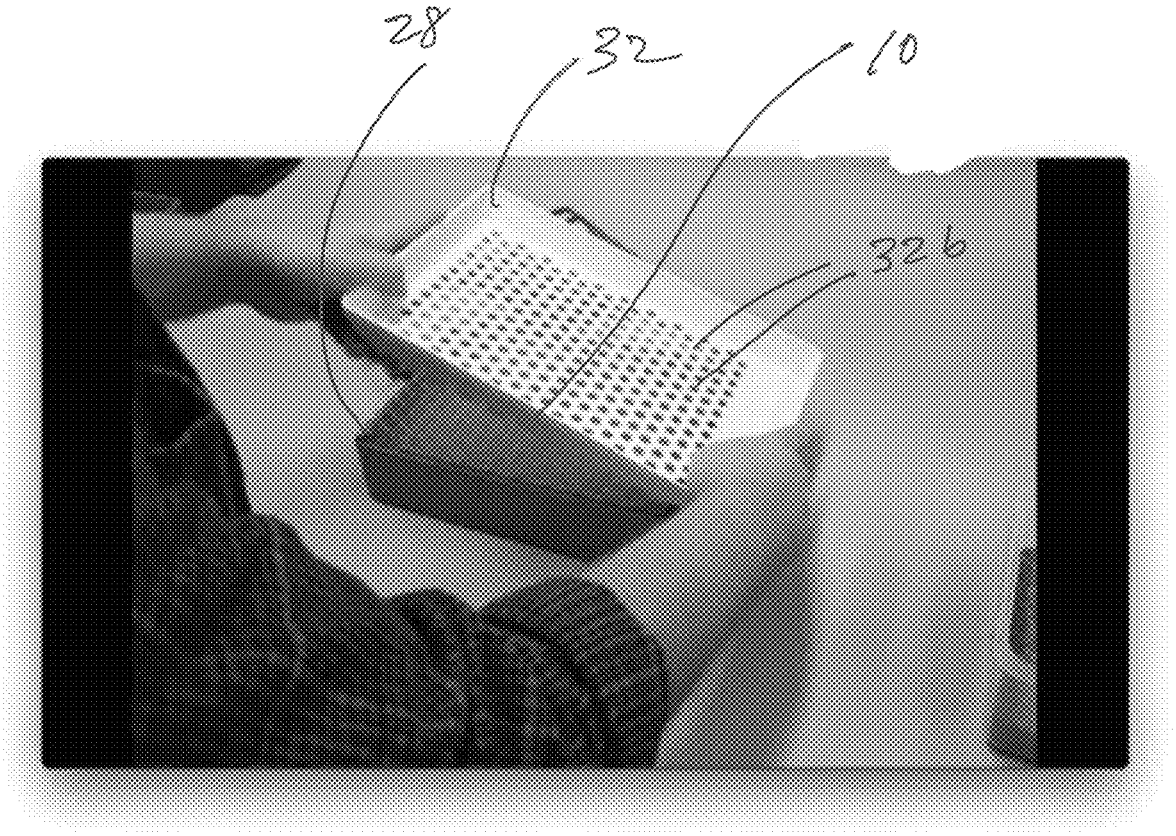
FIG. 22 show the filling tray in the process of being secured onto the top open ends of the bat pipes residing in the packing box.
Figure 23:
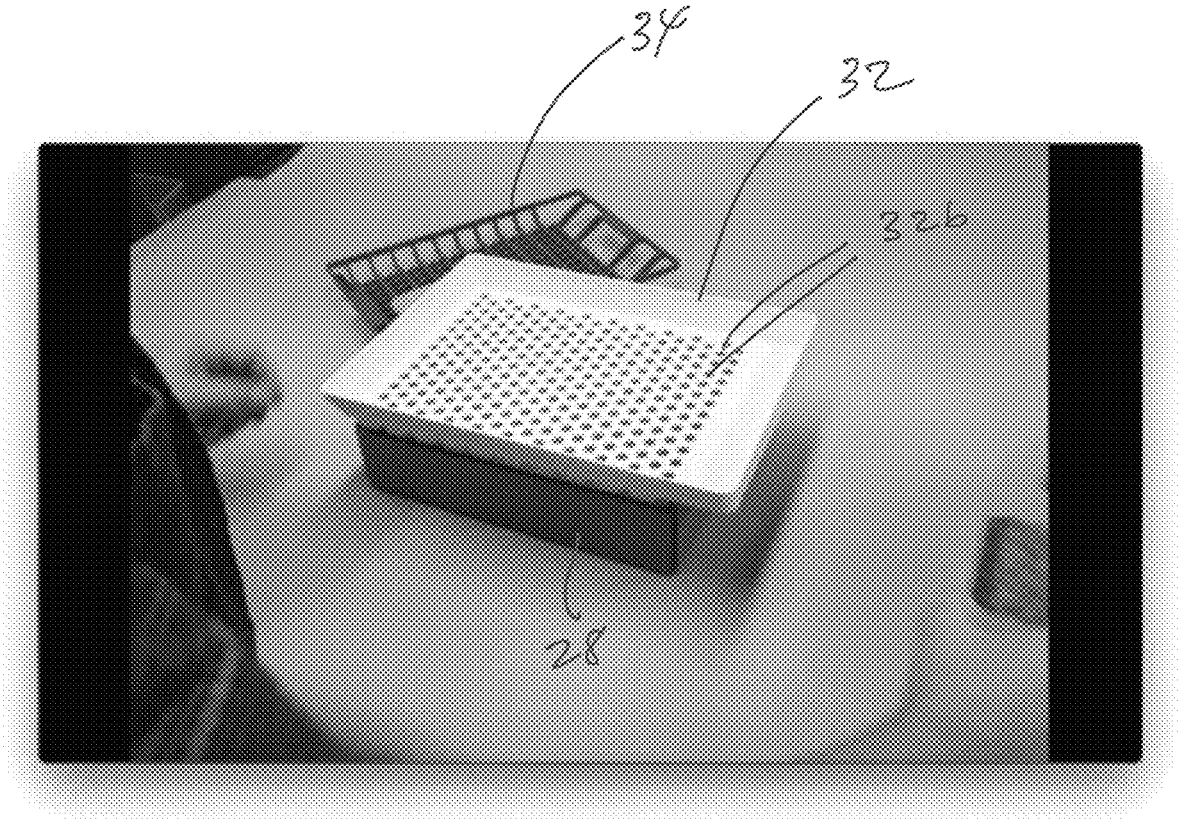
FIG. 23 show the filling tray secured onto the top open ends of the bat pipes residing in the packing box.

FIG. 22 shows the installation of the filling tray 32 on to the tops open ends 24 of the bat pipes 10. A downward press of the filling tray 32 onto the bat pipes 10 helps engage the frame 32*a* of filling tray 32 to orient the bat pipes 10 so they are in as much of an organized matrix as possible. Pressing down on the filling tray 32 causes alignment and, if needed, slight reorientation of the pipes 10 in the packing box 28 so the open tops thereof align with the holes 32*b* in the filling tray 32. Thus, as in FIG. 23, the filling tray 32 is fully installed onto the top open ends 24 of the glass bat pipes 10 whereby the top open ends 24 of the bat pipes 10 are aligned with the holes 32*b* through the filling tray 32.

Figure 24:
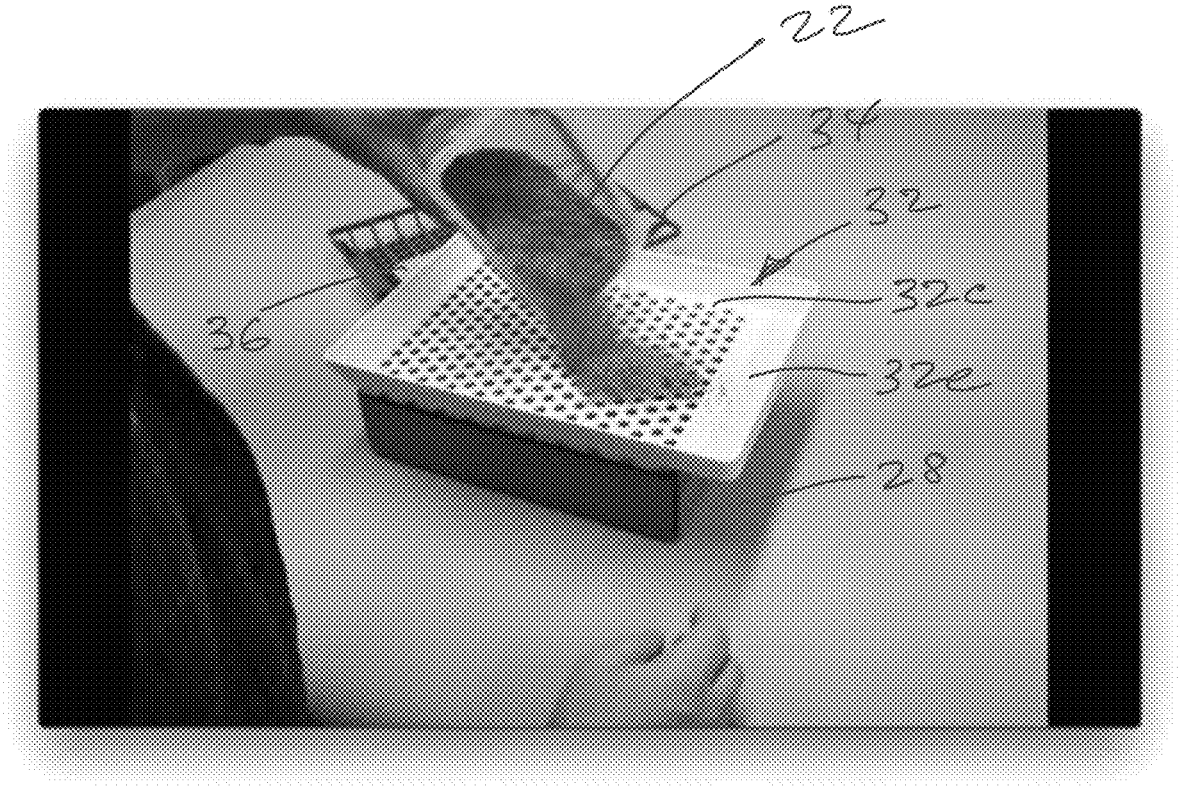
FIG. 24 show the pouring of a preferably measured amount of smokable plant matter on the top surface of the filling tray.
Figure 25:
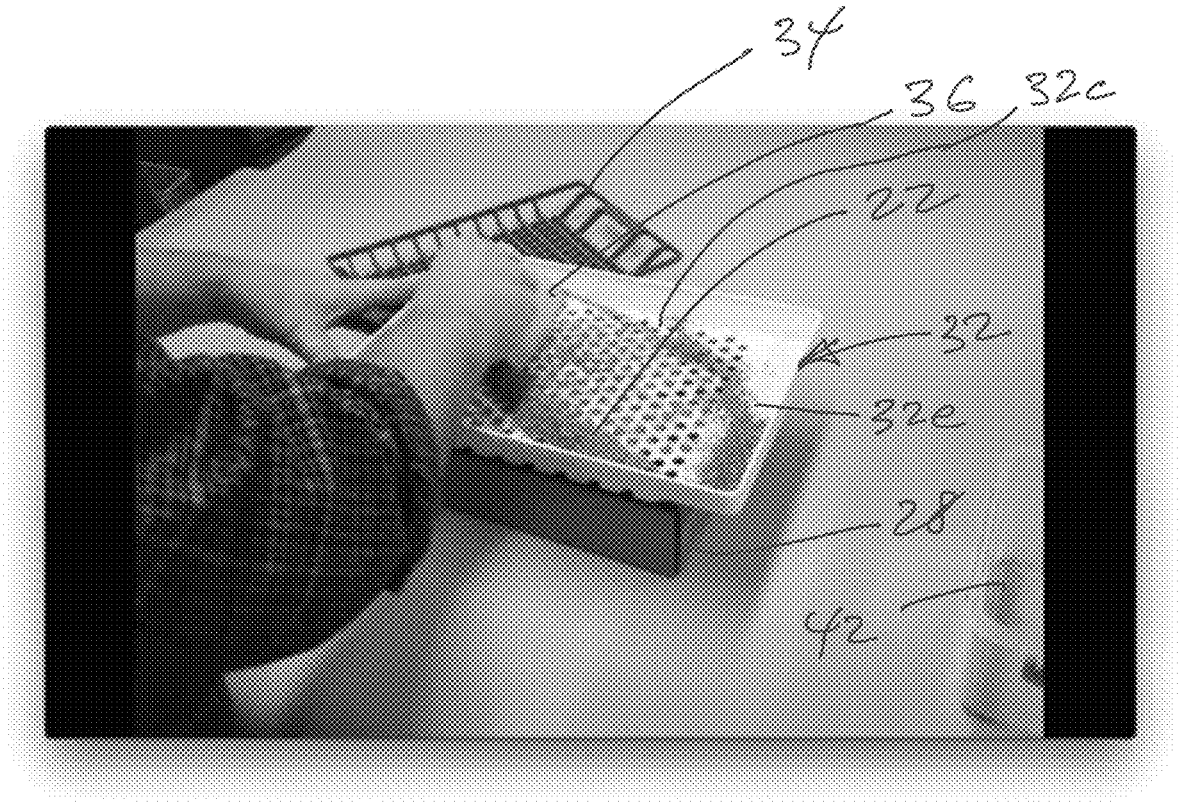
FIG. 25 shows the spreading of the smokable plant matter over the top surface of the filling tray and through the holes thereof and into the storage chambers of the bat pipes.
Figure 26:
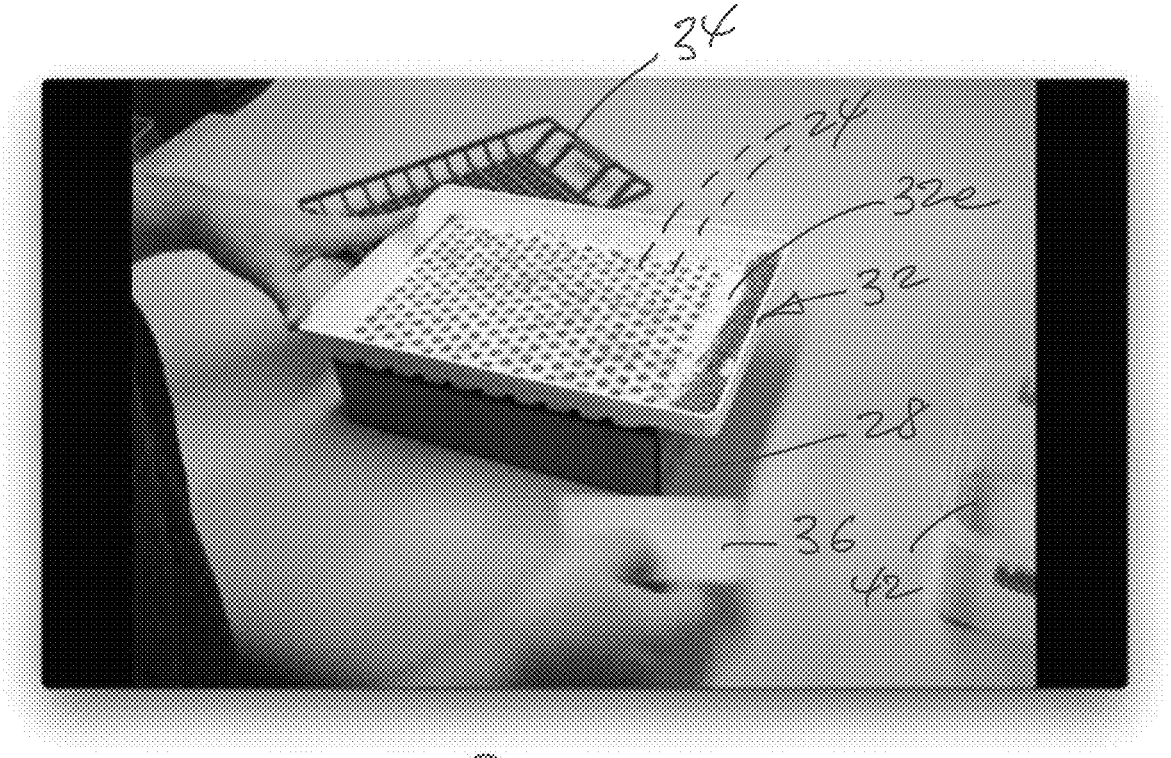
FIG. 26 shows the completion of the spreading of the smokable plant matter through the holes of the filling tray with excess smokable plant matter moved to the side.

FIGS. 24-26 illustrate the loading of smokable plant matter 22 into the storage chambers 14 of the bat pipes 10 via their respective top open ends 24, which are now located immediately under the holes 32*b* of the filling tray 32. In FIG. 24, smokable plant matter 22 is loaded on to the top surface 32*c* of the filling tray 32. In FIG. 25, the smokable plant matter 22 is spread across and over the holes 32*b* of the filling tray 32, preferably with the assistance of a spreading tool 36, where the smokable plant matter 22 is allowed, by gravity, to fall into the respective storage chambers 14 via the open top ends 24 of glass bat pipes 10 residing thereunder. In FIG. 26, the storage chambers 14 of the bat pipes 10 are filled with the desired amount of smokable plant matter 22. Excess smokable plant matter 22 can simply be pushed to the right side working area 32*e*.

Knowing the number bat pipes 10 in the array in the packing box 28, type of smokable plant matter 22 and other factors, it is possible to pour a preset amount of smokable plant matter 22 onto the top surface 32*c* of the filling tray 32, which could be used for accurate dosing. In the event that there is any extra smokable plant matter 22, if any, in this case, it can be moved to the side area 32*e* and then later poured out, as described below.

Figure 27:
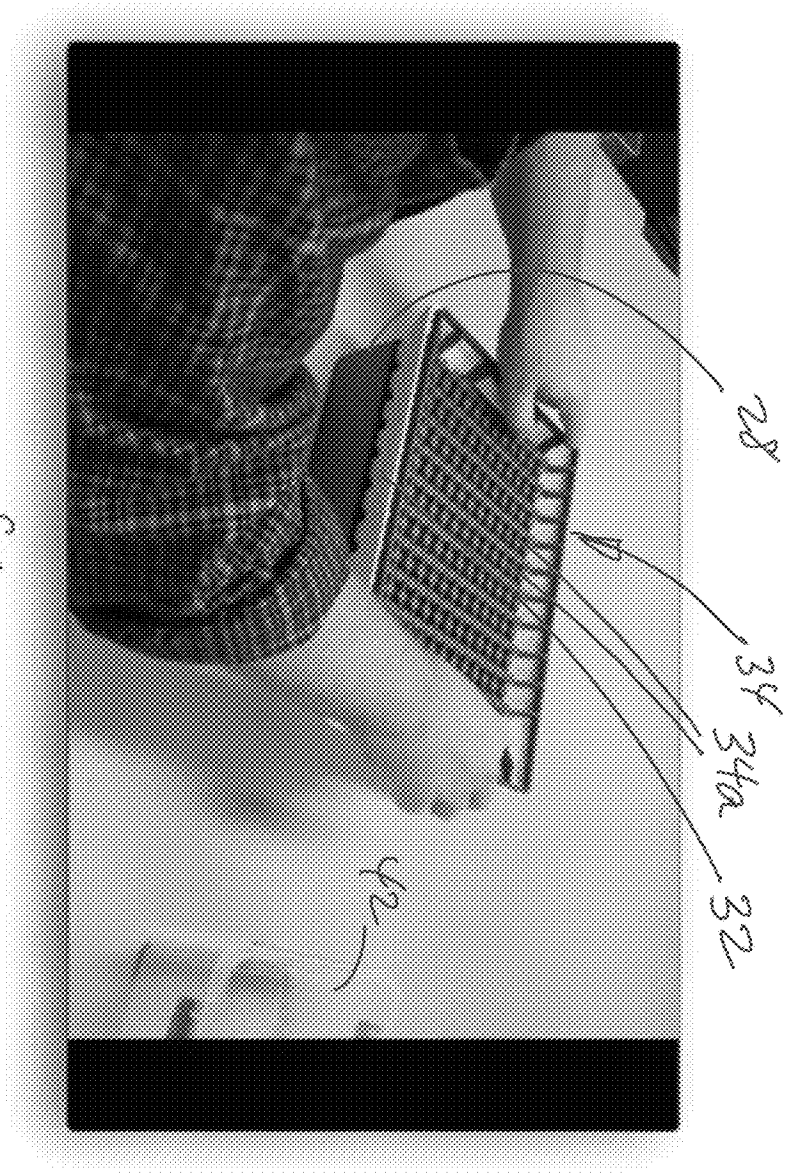
FIG. 27 shows the placing of the press plate onto the top surface of the filling tray.
Figure 28:
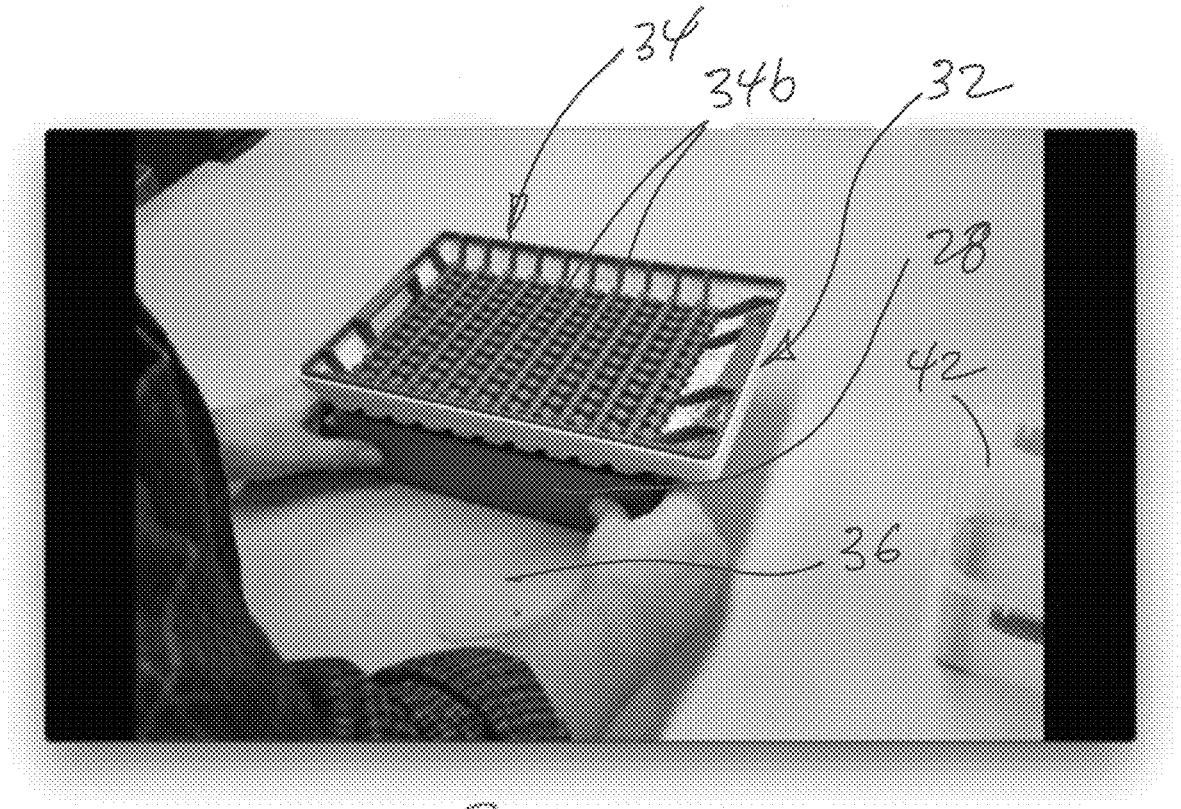
FIG. 28 shows completion of pressing of the press plate into the filling tray.

In FIGS. 27 and 28, use of press plate 34 for compaction of the smokable plant matter 22 is shown. In FIG. 27, the press plate 34 is located over the filling tray 32 and then pressed downwardly so the press plate 34 nests within the filling tray 32. The press plate 34, with its matrix of pegs 34*a* that align and interface with the holes 32*b* in the filling tray 32 and top open ends 24 of the bat pipes 10, is urged downwardly into and mated with the filling tray 32. The downward pressure of press plate 34 into the filling 32 tray causes the pegs 34*a* to pass through the holes 32*b* in the filling tray 32 and penetrate the top open ends 24 of the bat pipes 10, namely the storage chambers 14 thereof to thereby, compress/pack the smokable plant matter 22 in each of the bat pipes 10. This compaction or compression of the smokable plant matter 22 desirously leaves a small margin or gap at the top of the storage chambers 14 of the glass bat pipes 10 in preparation for later receipt of a sealing cap 26. The removal of smokable plant matter 22 at the top of the storage chamber 14 that will receive the sealing cap 26 is desired because it will result in a better press/friction fit of cap 26 because the cap 26 is communicating directly with the inner surface of the side walls of the bat pipe 10 without smokable plant matter 22 therebetween which could negatively impact the effectiveness of the cap seal.

Figure 29:
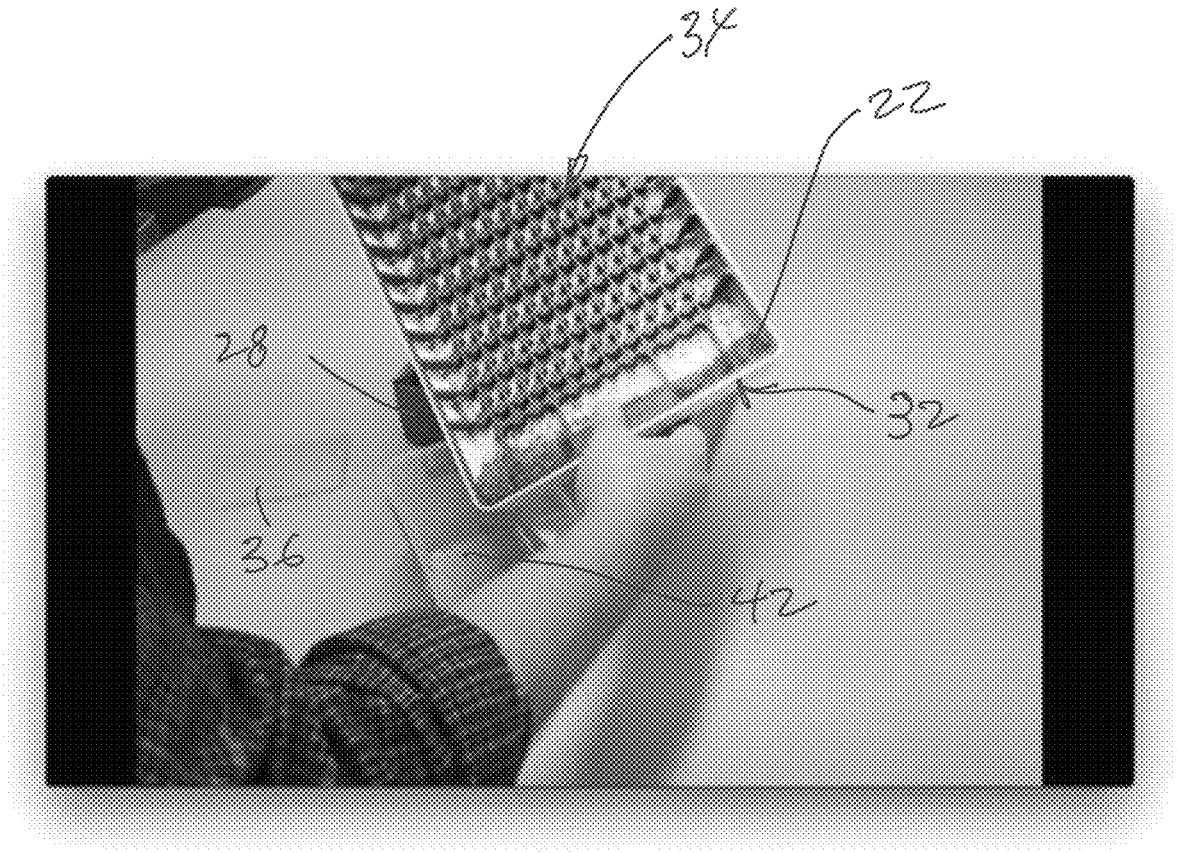
FIG. 29 shows pouring off excess smokable plant matter from the filling tray.

In FIG. 29, the assembly of the press plate 34 and filling tray 32 are lifted off of the tops 24 of the bat pipes 10 and excess smokable plant matter 22, if any, is poured out of the nested assembly of the press plate 34 and filling tray 32 assembly into an overflow container 42. Such excess smokable plant matter 22 can be used during the next filling operation of a new empty array of bat pipes 10.

Figures 1A, 1B, 1C:
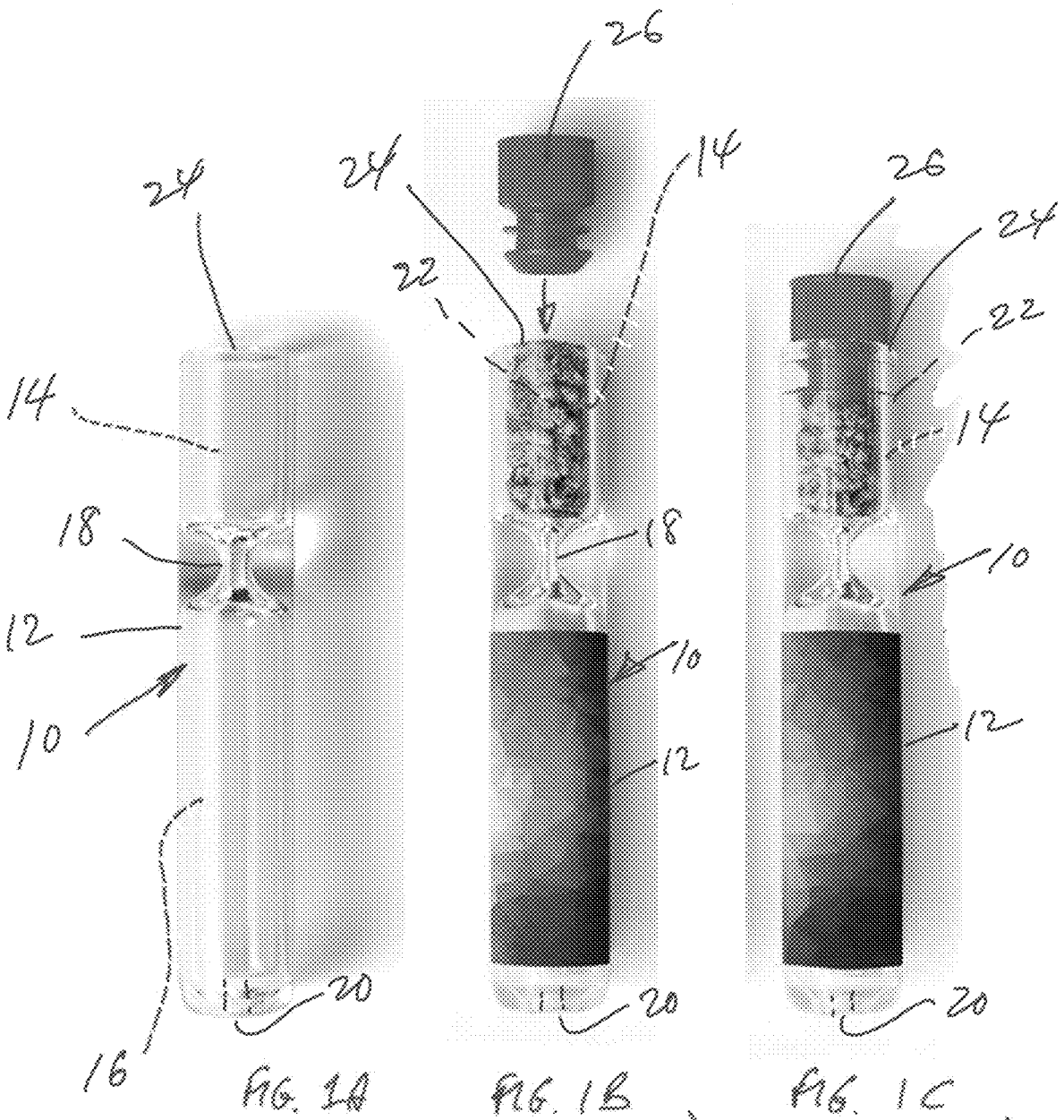
FIG. 1A (Prior Art)
FIG. 1B (Prior Art)
FIG. 1C (Prior Art)
FIG. 1A shows a known glass bat pipe of the prior art.
FIG. 1B shows a glass bat pipe in the process of be manually filled with smokable plant matter.
FIG. 1C is a glass bat pipe that has been manually filled with smokable plant matter with a sealing cap in place.
Figure 30:
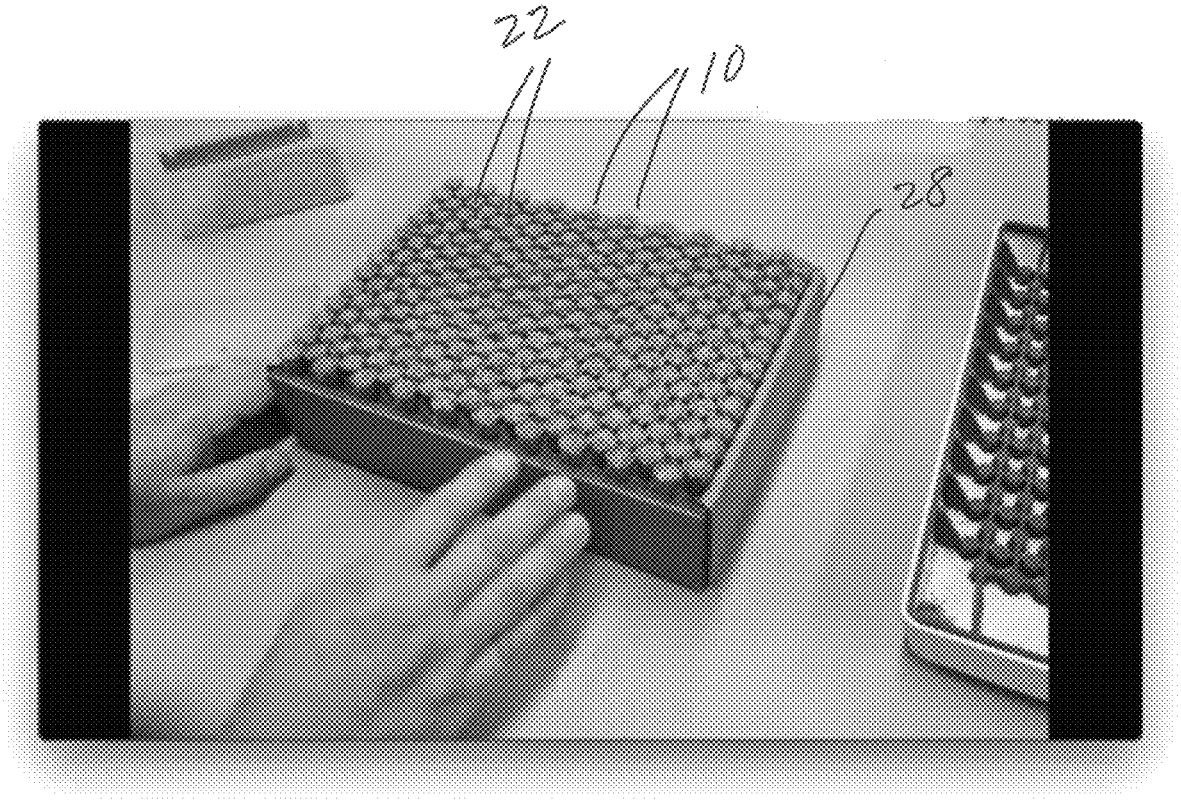
FIG. 30 shows the completed filled bat pipes with filling tray and press plate removed in preparation for capping.

With the filling tray 32 and press plate 34 completed removed, as in FIG. 30, an array of fully filled bat pipes 10 are left remaining in the packing box 28 with the desired amount of smokable plant matter 22 in a neat and quick fashion. Finally, caps 26, of the like shown in FIGS. 1A-C are then secured to the open tops 24 of the now filled glass bat pipes 10 to seal them closed. Thus, the bat pipes 10 are filled and then capped off all without removing the containers from the packing box 28. The filled and sealed bat pipes 10 result, essentially, in a completed and filled bat pipe 10 of the like shown in the manually filled bat pipe 10 shown in FIG. 1C. The packing box 28 of resultant filled glass bat pipes 10 can now be placed on display for sale, stored or further shipped. For example, a packing box cover (not shown) can be placed over the entire filled and sealed array of bat pipes 10 in packing box 28 or shrink-wrapped, or the like, for storage or shipping.

During the entire filling process, the glass bat pipes 10 are never removed from their packing box 28, which greatly reduces handling of the bat pipes 10 thereby reducing possibilities of damage to the bat pipes 10 while avoiding inconsistency in filling amounts.

It should be noted that the packing box 28 can sized and configured so 250 bat pipes 10 in a square or rectangular grid, as an example, can be stored. However, the present invention may be configured and arranged to accommodate a packed packing box 28 that is sizes and configured to hold any number of bat pipes 10 therein, regardless of the size of the arrangement of the bat pipes 10. The filling tray 32 and press plate 34 can be easily configured to accommodate such a packing box 28 of bat pipes 10. For example, multiple sets of filling trays 32 and press plates 34 can be provided depending on the size and number of bat pipes 10 therein.

Figure 31A:
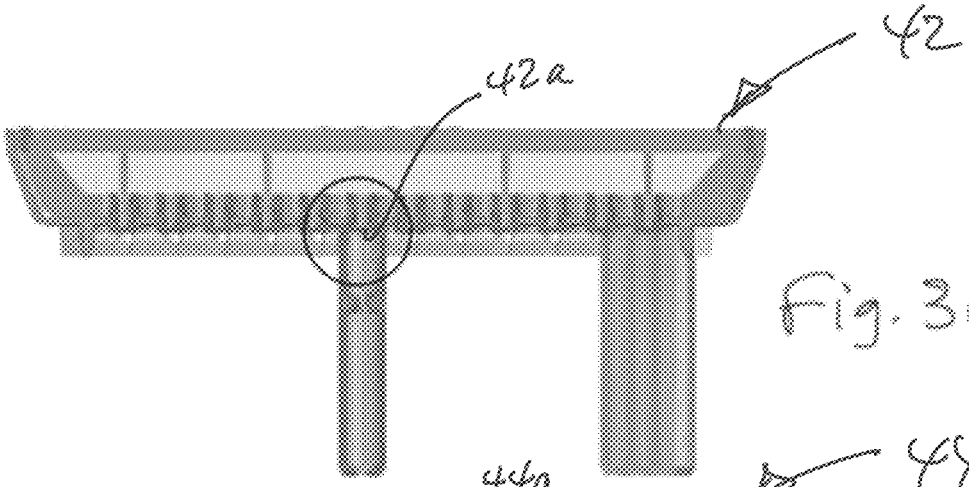
FIG. 31A shows an alternative embodiment of the press plate of the present invention with an array of pegs having a first pre-selected length.
Figure 31B:
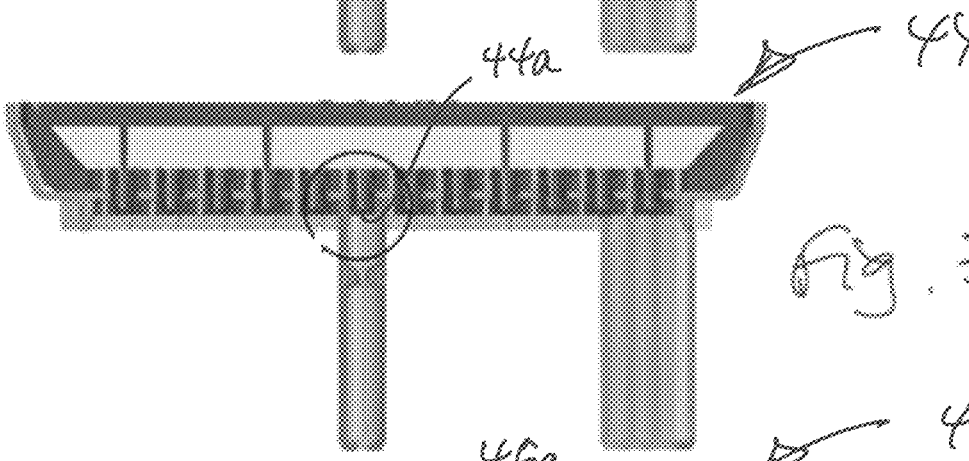
FIG. 31B shows an alternative embodiment of the press plate of the present invention with an array of pegs having a second pre-selected length.
Figure 31C:
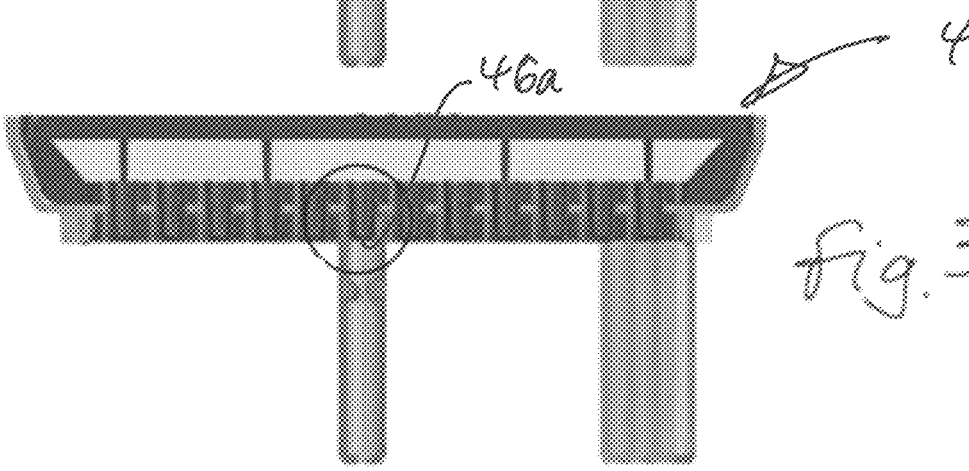
FIG. 31C shows an alternative embodiment of the press plate of the present invention with an array of pegs having a third pre-selected length.

For example, as shown in FIGS. 31A-C, a set of multiple press plates 42, 44, 46, each with a different length of pegs 42*a*, 44*a*, 46*a*, respectively, can be provided to a user to give them an option to provide different amounts of compaction or packing of smokable plant matter 22. For example, a set of three press plates 42, 44, 26 may be provided, including respectively, approximately 0.1 inch penetration (FIG. 31A), approximately 0.2 inch penetration (FIG. 31B) and approximately 0.36 inch penetration (FIG. 31C). This further provides an option for the user to account for different types of smokable plant matter 22 that is being filled into the bat pipes 10.

Figure 32A:
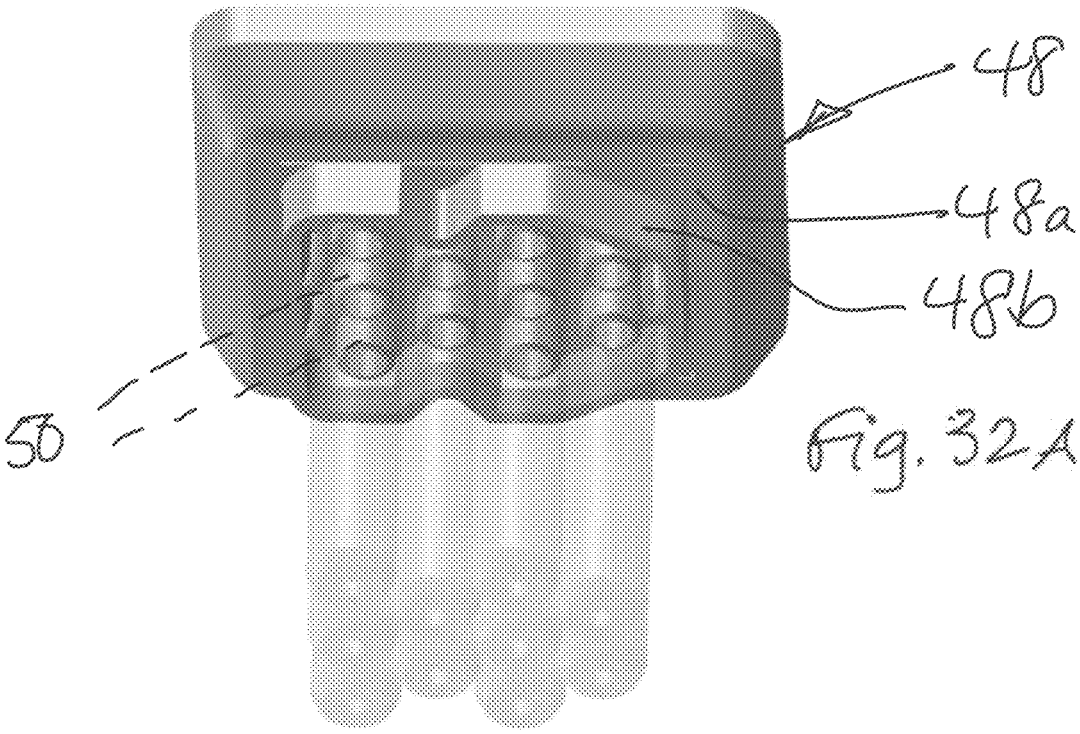
FIG. 32A shows a bottom perspective view of an alternative embodiment of the filling tray with collar spacers and alignment frame.
Figure 32B:
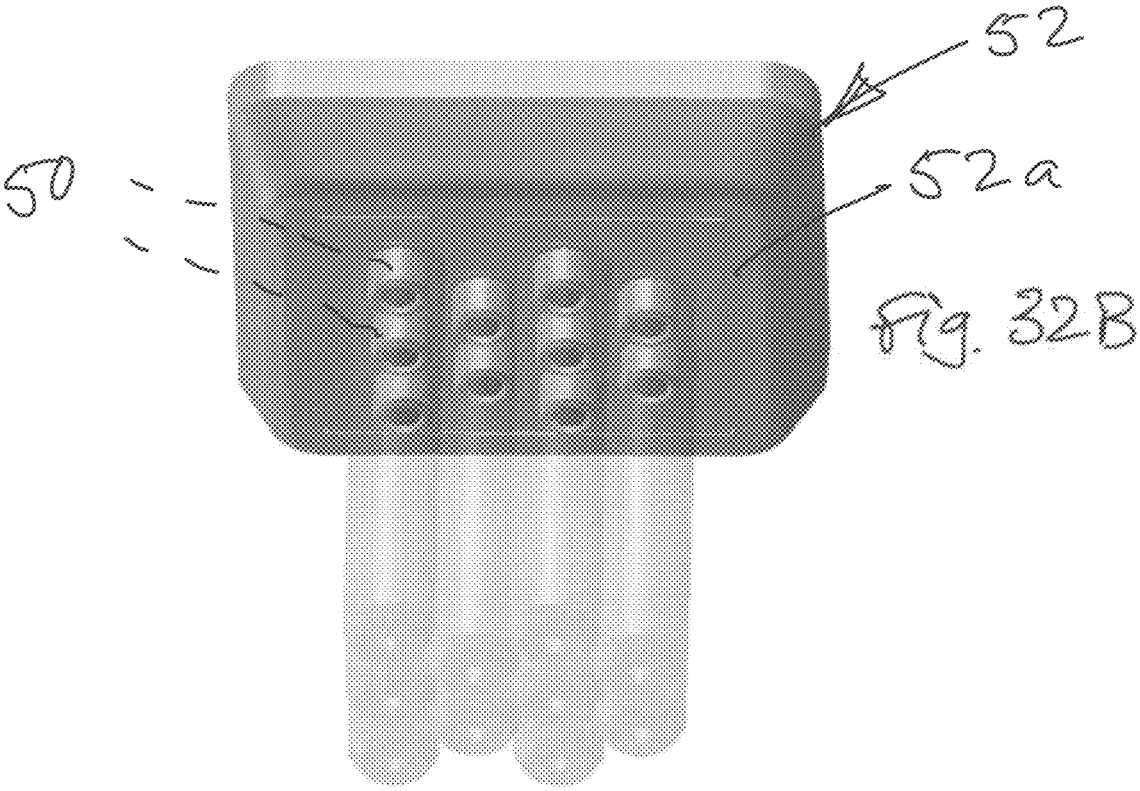
FIG. 32B shows a bottom perspective view of a further alternative embodiment of the filling tray with collar spacers and no alignment frame.

Also, as a further way to control the amount of smokable plant matter 22 that is being filled into the storage chambers 14 of the bat pipes 10, the filling tray 48 may be modified to include space-filling collars 50 that downward depend from the bottom surface 48*a* of the filling tray 48. FIGS. 32A and 32B show an alternative embodiment of the filling tray 48, 52, for a smaller array of bat pipes, that uses such collars 50 to extend into the storage chambers 14. FIG. 32A shows this alternate embodiment with the alignment frame structure 48*b* of the nature described above. On the other hand, FIG. 32B shows an alternative embodiment of the filling tray 52 that does not include an alignment frame on the bottom surface 52*a* of the filling tray 52. For the alternative embodiment of the filling tray 52 of FIG. 32B, the downwardly depending collars 50 can be used for alignment purposes to the bat pipes 10 rather than the alignment frame structure 48*b*.

Thus, the use of such collars 50 enables the adjustment the amount of smokable plant matter 22 that is loaded into the storage chamber 14, which may be desirable in certain circumstances. Therefore, the amount of smokable plant matter 22 that can enter the storage chambers 14 can be limited, as desired, despite a spreading operation over the top surface 32*c* of the filling tray 32. Furthermore, collars 50 of different sizes and lengths can be used so the amount of fill volume can be easily selected within the storage chambers 14 of the glass pipe 10 can be selected by the user. This allows the storage chambers 14 to be filled to different volumes/weights as defined by the sizing of the collars 50.

It will be appreciated by those skilled in the art that various changes and modifications can be made to the illustrated embodiments without departing from the spirit of the present disclosure. All such modifications and changes are intended to be covered by the appended claims.

What is claimed is:

1. An apparatus for filling a plurality of bat pipes with top open ends, comprising:

an array of bat pipes with open top ends;

a filling tray having a top surface and a bottom surface and including of a plurality of holes; the plurality of holes respectively aligning with the top open ends of the plurality of bat pipes; the filling tray including an upstanding side wall;

a press plate having a plurality of pegs downwardly depending therefrom; the plurality of pegs aligning and interfacing with the plurality of holes in the filling tray and top open ends of the plurality of bat pipes; the pegs being configured and arranged to respectively extend through the plurality of holes in the filling tray and into the top open ends of the plurality of bat pipes; the press plate being dimensioned to nest within the upstanding side wall of the filling tray;

whereby the filling tray is positionable over the top open ends of the plurality of bat pipes for receipt of smokable plant matter thereon for distribution of the smokable plant matter into the top open ends of the plurality of bat pipes; the upstanding side wall of the filling tray assisting in retaining the smokable plant matter on the filling tray;

whereby the press plate is positionable over the filling tray and configured and arranged to be pressed downwardly to urge smokable plant matter into the top open ends of the plurality of bat pipes.

2. The apparatus of claim 1, wherein the filling tray includes a frame downwardly depending from and connected to the bottom surface of the filling tray; the frame being engageable with at least one of the plurality of bat pipes to assist in aligning the top open ends of the plurality of bat pipes with the plurality of holes in the filling tray.

3. The apparatus of claim 1, wherein the press plate includes at least one handle.

4. The apparatus of claim 1, wherein the filling tray and press plate are made of plastic.

5. The apparatus of claim 1, wherein the filling tray and press plate are made of metal.

6. The apparatus of claim 1, wherein the plurality of holes of the filling tray, the pegs of the press plate and the top open ends of the plurality of bat pipes are arranged in a matrix substantially the same as each other.

7. The apparatus of claim 1, further comprising:

an array of tubular collars downwardly depending from the bottom surface of the filling tray; the array of tubular collars being respectively co-axially aligned with the plurality of holes in the filling tray; the array of tubular collars respectively extending partially into the top open ends of the plurality of bat pipes; the tubular collars limiting the volume of smokable plant material to enter the top open ends of the plurality of bat pipes.

8. A method for filling bat pipes, comprising the steps of:

providing a plurality of bat pipes with top open ends;

providing a filling tray having an upstanding side wall, a top surface and a bottom surface and including of a plurality of holes;

placing the filling tray over the plurality of bat pipes with the plurality of holes of the filling tray respectively aligning with the top open ends of the plurality of bat pipes;

spreading smokable plant matter over the filling tray and into the top open ends via the plurality of holes of the filling tray; during the step of spreading, the upstanding side wall of the filling tray assisting in retaining the smokable plant matter on the filling tray;

providing a press plate having a plurality of pegs downwardly depending therefrom; the press plate being dimensioned to nest within the upstanding side wall of the filling tray; and urging the press plate into the filling tray with the pegs being respectively driven through the plurality of holes in the filling tray and into respective compression engagement with smokable plant matter residing in the top open ends of the plurality of bat pipes; the compression engagement thereby packing the smokable plant matter into the plurality of bat pipes.

9. The method of claim 8, further comprising the step of:

providing a frame downwardly depending from and connected to the bottom surface of the filling tray;

engaging the frame with at least one of the plurality of bat pipes;

aligning the top open ends of the plurality of bat pipes with the plurality of holes in the filling tray.

10. The method of claim 8, further comprising the step of:

removing the filling tray and the press plate from the top open ends of the plurality of bat pipes.

11. The method of claim 8, further comprising the step of:

securing caps to the top open ends of the plurality of bat pipes.

12. The method of claim 8, wherein the press plate includes at least one handle.

13. The method of claim 8, wherein the filling tray and press plate are made of plastic.

14. The method of claim 8, wherein the filling tray and press plate are made of metal.

15. The method of claim 8, further comprising the step of:

arranging the plurality of holes of the filling tray, the pegs of the press plate and the top open ends of the plurality of bat pipes in a matrix substantially the same as each other.

16. The method of claim 8, further comprising the step of:

providing an array of tubular collars downwardly depending from the bottom surface of the filling tray; the array of tubular collars being respectively co-axially aligned with the plurality of holes in the filling tray;

partially extending the array of tubular collars respectively into the top open ends of the plurality of bat pipes upon placing the filling tray over the plurality of bat pipes with the plurality of holes of the filling tray respectively aligning with the top open ends of the plurality of bat pipes;

limiting the volume of smokable plant material to enter the top open ends of the plurality of bat pipes.

* * * * *